US012350543B2

(12) United States Patent
Rubin et al.

(10) Patent No.: US 12,350,543 B2
(45) Date of Patent: Jul. 8, 2025

(54) EXERCISE SYSTEMS

(71) Applicant: Meegan Rubin, Villanova, PA (US)

(72) Inventors: Meegan Rubin, Villanova, PA (US); Clay Cooper Péquignot, Devon, PA (US)

( * ) Notice: Subject to any disclaimer, the term of this patent is extended or adjusted under 35 U.S.C. 154(b) by 16 days.

(21) Appl. No.: 17/513,573

(22) Filed: Oct. 28, 2021

(65) Prior Publication Data

US 2022/0126154 A1 Apr. 28, 2022

Related U.S. Application Data

(60) Provisional application No. 63/106,875, filed on Oct. 28, 2020.

(51) Int. Cl.
*A63B 21/00* (2006.01)
*A63B 21/055* (2006.01)

(52) U.S. Cl.
CPC ..... *A63B 21/4029* (2015.10); *A63B 21/0552* (2013.01); *A63B 2208/0252* (2013.01)

(58) Field of Classification Search
CPC . A63B 21/04; A63B 21/0552; A63B 21/4029; A63B 21/00047; A63B 21/0005–00054; A63B 21/055–0557; A63B 21/078; A63B 21/4037; A63B 21/4038; A63B 23/0222; A63B 23/0238; A63B 71/0036; A63B 2208/0252; A63B 2209/00
See application file for complete search history.

(56) References Cited

U.S. PATENT DOCUMENTS 1,904,039 A * 4/1933 Bruder ..... A63B 23/0211 606/240
D284,394 S 6/1986 Bengtson et al.
5,423,087 A 6/1995 Krent et al.
(Continued)

OTHER PUBLICATIONS

New Image, "New Image Unisex's FITT Curve All-in-One Inflatable Workout System" available at https://www.amazon.com/New-Image-Unisexs-Inflatable-Workout/dp/B08P54FJPD accessed on Oct. 25, 2021.

(Continued)

*Primary Examiner* — Loan B Jimenez
*Assistant Examiner* — Kathleen M Fisk
(74) *Attorney, Agent, or Firm* — Fox Rothschild LLP

(57) ABSTRACT

Disclosed exercise systems may include a wavelike body having at least two peaks and a trough therebetween extending longitudinally along a longitudinal axis and a laterally along a widthwise axis perpendicular to the longitudinal axis, the wavelike body including a core component and a surface component surrounding the core component, for example. In various embodiments, the wavelike body may have at least one aperture extending laterally therethrough for securing an elastic band. In some embodiments, the core component may be formed of a rigid foam, e.g., a Poly Foam, and the surface component may be formed a relatively softer foam, e.g., an EVA foam. In some embodiments a plurality of apertures for securing an elastic chord or ribbon may extend through a sidewall of the wavelike body. In some embodiments, at least one aperture may extend through the core component and the surface component.

17 Claims, 38 Drawing Sheets

(56) References Cited

U.S. PATENT DOCUMENTS

| | | | | |
|---|---|---|---|---|
| 5,551,935 | A * | 9/1996 | Pustaver | A63B 21/00047 482/142 |
| 5,584,786 | A * | 12/1996 | Almeda | A63B 23/0211 482/142 |
| 5,795,276 | A * | 8/1998 | Almeda | A63B 23/0211 606/240 |
| 6,299,569 | B1 | 10/2001 | Rich | |
| 6,740,008 | B1 | 5/2004 | Ho et al. | |
| 7,217,228 | B2 | 5/2007 | Marquez | |
| D555,741 | S * | 11/2007 | Wachtfogel | D21/662 |
| 7,563,217 | B2 * | 7/2009 | Endelman | A63B 21/00047 482/121 |
| 7,591,763 | B1 | 9/2009 | Fucci | |
| 8,033,969 | B2 * | 10/2011 | Feltz | A63B 22/16 482/142 |
| 9,615,611 | B2 * | 4/2017 | Wyner | B32B 29/007 |
| 10,220,236 | B2 | 3/2019 | Oltorik, Jr. | |
| 10,286,244 | B2 | 5/2019 | Reese | |
| 10,463,904 | B1 * | 11/2019 | Bright | A63B 21/0442 |
| 10,610,728 | B2 | 4/2020 | Fano et al. | |
| 10,729,932 | B2 * | 8/2020 | Cooper | A63B 21/0442 |
| 11,260,263 | B2 * | 3/2022 | Cook | A63B 21/4029 |
| 2006/0122043 | A1 | 6/2006 | Van Straaten | |
| 2006/0128540 | A1 | 6/2006 | Engle | |
| 2010/0152004 | A1 | 6/2010 | Feltz | |
| 2011/0207587 | A1 * | 8/2011 | De La Rambelje | A63B 21/4039 482/140 |
| 2012/0165167 | A1 | 6/2012 | Hauptmann | |
| 2018/0085623 | A1 * | 3/2018 | Flook | A63B 21/0557 |
| 2018/0290002 | A1 | 10/2018 | Colangelo | |
| 2021/0228936 | A1 | 7/2021 | Reed, III | |
| 2021/0298980 | A1 * | 9/2021 | Thek | A63B 21/0442 |

OTHER PUBLICATIONS

Sweatbotics LLC, "Sweatbox" accessed at https://www.sweatbox1.com/ on Oct. 25, 2021.

International Search Report and Written Opinion mailed Jan. 27, 2022 in International Application No. PCT/US2021/057091.

* cited by examiner

EXERCISE SYSTEMS

CROSS-REFERENCE TO RELATED APPLICATIONS

This non-provisional application claims priority to and the benefit of: U.S. Provisional Application Ser. No. 63/106,875, titled Exercise Systems, filed Oct. 28, 2020. The entire contents of which are incorporated herein by reference. This application also incorporates by reference the entire contents of U.S. Design Application Ser. No. 29/756,168, filed Oct. 26, 2020.

FIELD

The present technology is generally related to exercise equipment and methods of manufacturing exercise equipment.

BACKGROUND

Conventional exercise equipment such as treadmills, stair-steppers, stationary bicycles, and Pilates equipment can be overly taxing and difficult to use for resistance and/or strength training. The various sizes and weights of such conventional equipment may also make them inconvenient to transport, keep and store. Additionally, conventional exercise support equipment, such as Pilates cushions, are formed of a single relatively heavy and rigid material and do not have significant durability when used under stress loading nor are they comfortable and lightweight to use.

SUMMARY

The techniques of this disclosure generally relate to exercise equipment and in particular exercise equipment having an ergonomic and/or wavelike supporting body and at least one aperture extending therethrough for supporting an elastic exercise band.

In one aspect, the present disclosure provides for an exercise system, the system including a wavelike body having at least two peaks and a trough therebetween, the body extending longitudinally along a longitudinal axis and a laterally along a widthwise axis perpendicular to the longitudinal axis, for example. The system also having at least one aperture extending laterally therethrough for securing an elastic band or ribbon, for example.

In another aspect, the disclosure provides for an exercise system. The system may include a wavelike body having at least two peaks and a trough therebetween extending longitudinally along a longitudinal axis and a laterally along a widthwise axis perpendicular to the longitudinal axis, the wavelike body including a core component and a surface component surrounding the core component, for example. In various embodiments, the wavelike body may have at least one aperture extending laterally therethrough.

In another aspect, the disclosure is directed to a multi-component exercise cushion formed by a method of manufacture, for example. The method of manufacture may include forming a wavelike body comprising at least two peaks and a trough therebetween and extending longitudinally along a longitudinal axis and laterally along a widthwise axis perpendicular to the longitudinal axis, for example. In various embodiments, the wavelike body may be formed of a first foam component and a second foam component surrounding the first foam component, for example. The method of manufacture may further include molding a first foam component including a first foam material having a first rigidity and molding a second foam component having a second foam material having a second rigidity less than the first rigidity, for example. The method of manufacture may further include coupling the first foam component to the second foam component by a crosslinking adhesive process, for example. In various embodiments, the exercise system may include at least one aperture extending laterally therethrough for securing an elastic band.

The details of one or more aspects of the disclosure are set forth in the accompanying drawings and the description below. Other features, objects, and advantages of the techniques described in this disclosure will be apparent from the description and drawings, and from the claims.

DETAILED DESCRIPTION

Figure 1:
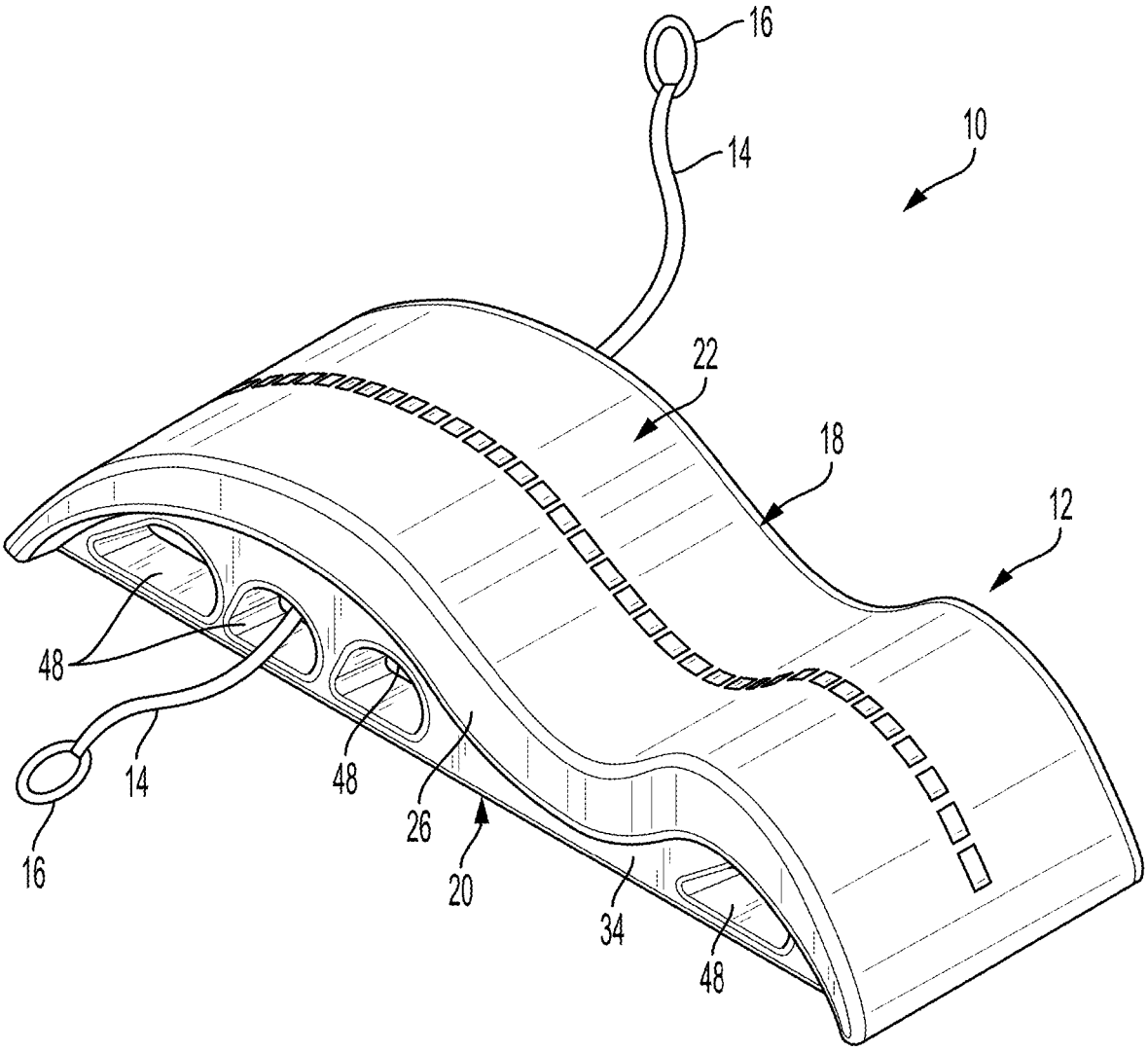
FIG. 1 is a perspective view of an exercise system.

Embodiments of the present disclosure relate generally, for example, to exercise systems, and more particularly, to exercise systems having various built in locations for securing resistance bands. Embodiments of the devices and methods of manufacture are described below with reference to the Figures.

It is noted that various embodiments are described in detail with reference to the drawings, in which like reference numerals represent like parts and assemblies throughout the several views, where possible. Reference to various embodiments does not limit the scope of the claims appended hereto because the embodiments are examples of the inventive concepts described herein. Additionally, any example(s) set forth in this specification are intended to be non-limiting and set forth some of the many possible embodiments applicable to the appended claims. Further, particular features described herein can be used in combination with other described features in each of the various possible combinations and permutations unless the context or other statements clearly indicate otherwise.

Terms such as "same," "equal," "planar," "coplanar," "parallel," "perpendicular," etc. as used herein are intended to encompass a meaning of exactly the same while also including variations that may occur, for example, due to manufacturing processes. The term "substantially" may be used herein to emphasize this meaning, particularly when the described embodiment has the same or nearly the same functionality or characteristic, unless the context or other statements clearly indicate otherwise.

Figure 2:
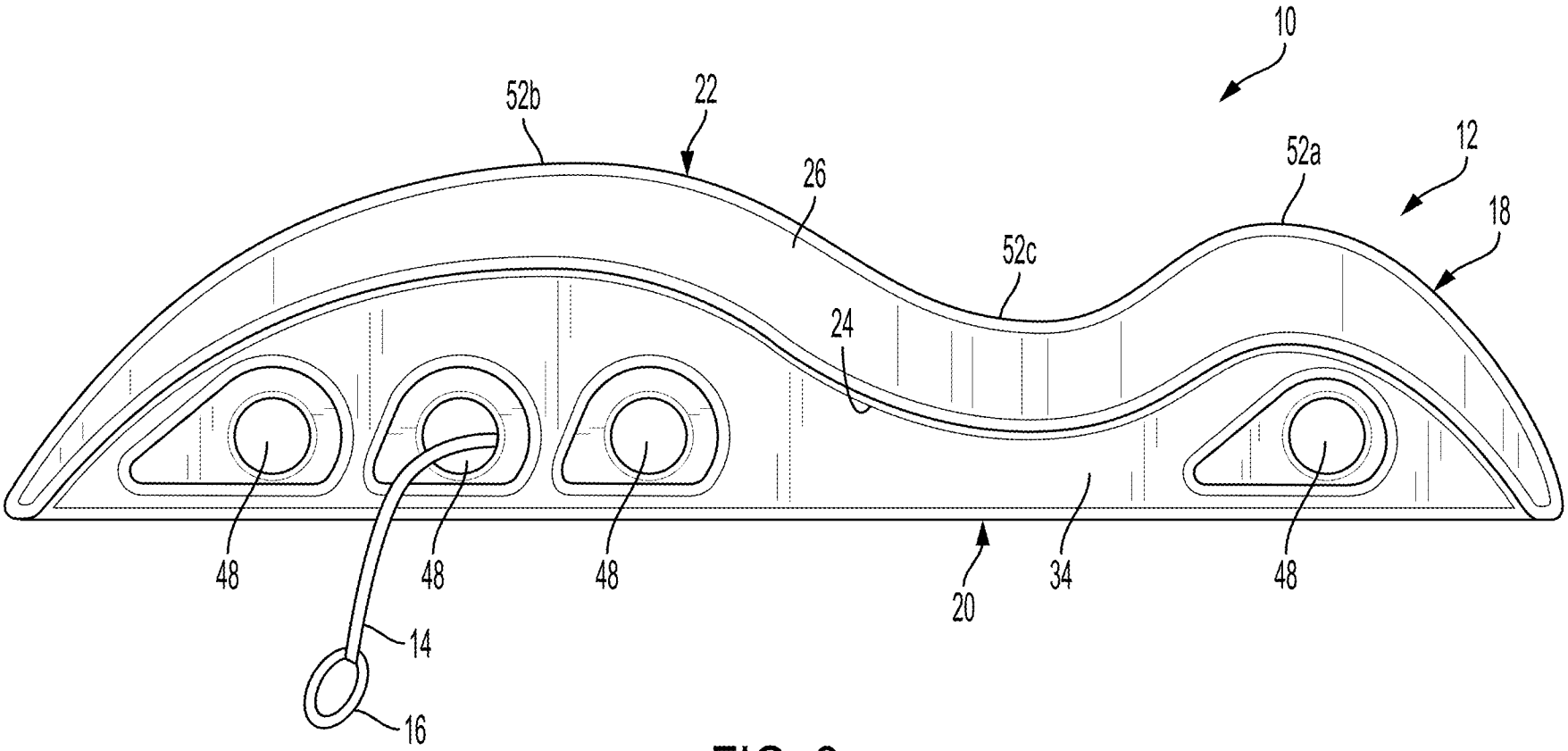
FIG. 2 is a side view of the embodiment of FIG. 1.
Figure 3:
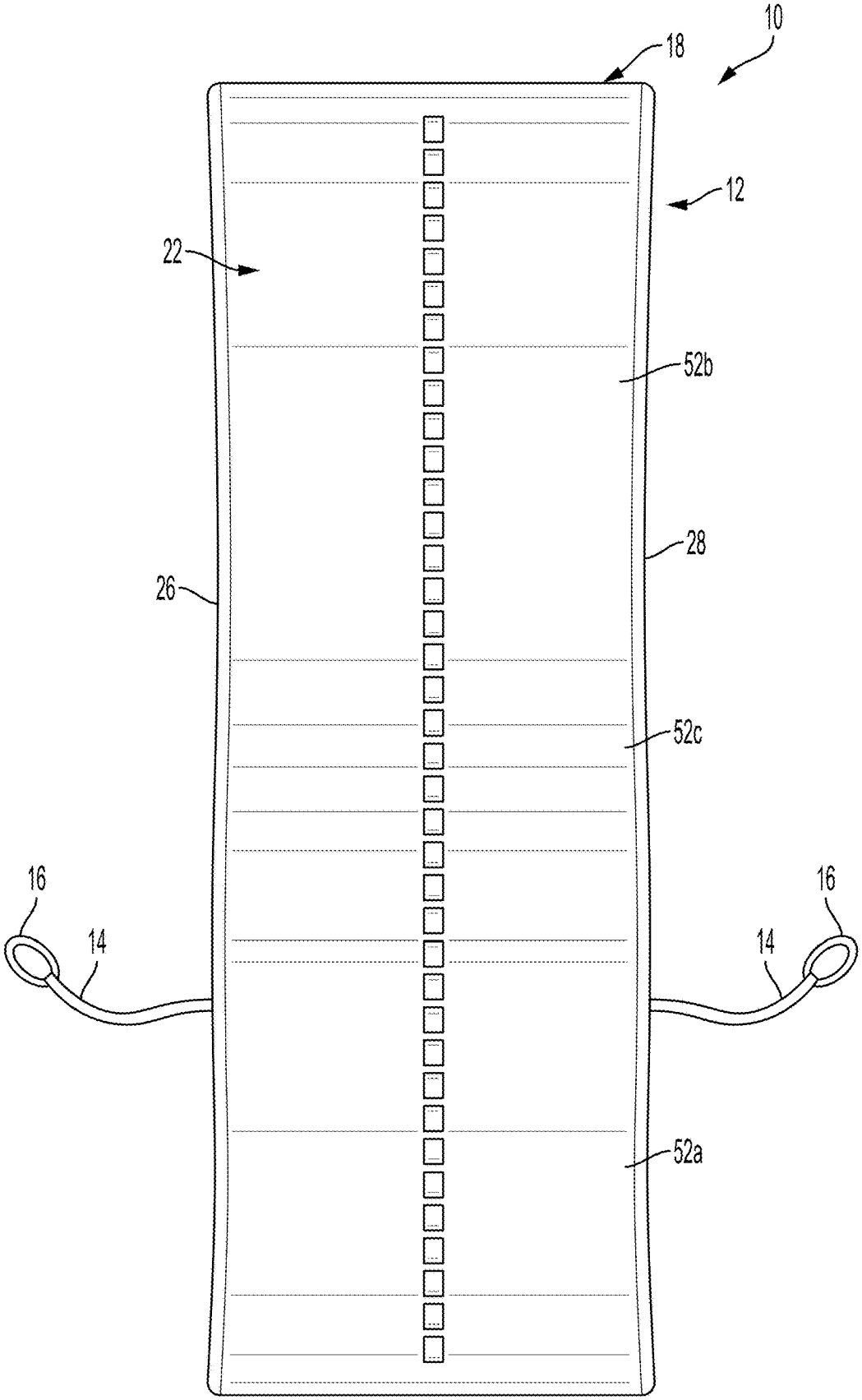
FIG. 3 is a top down view of the embodiment of FIG. 1.
Figure 4:
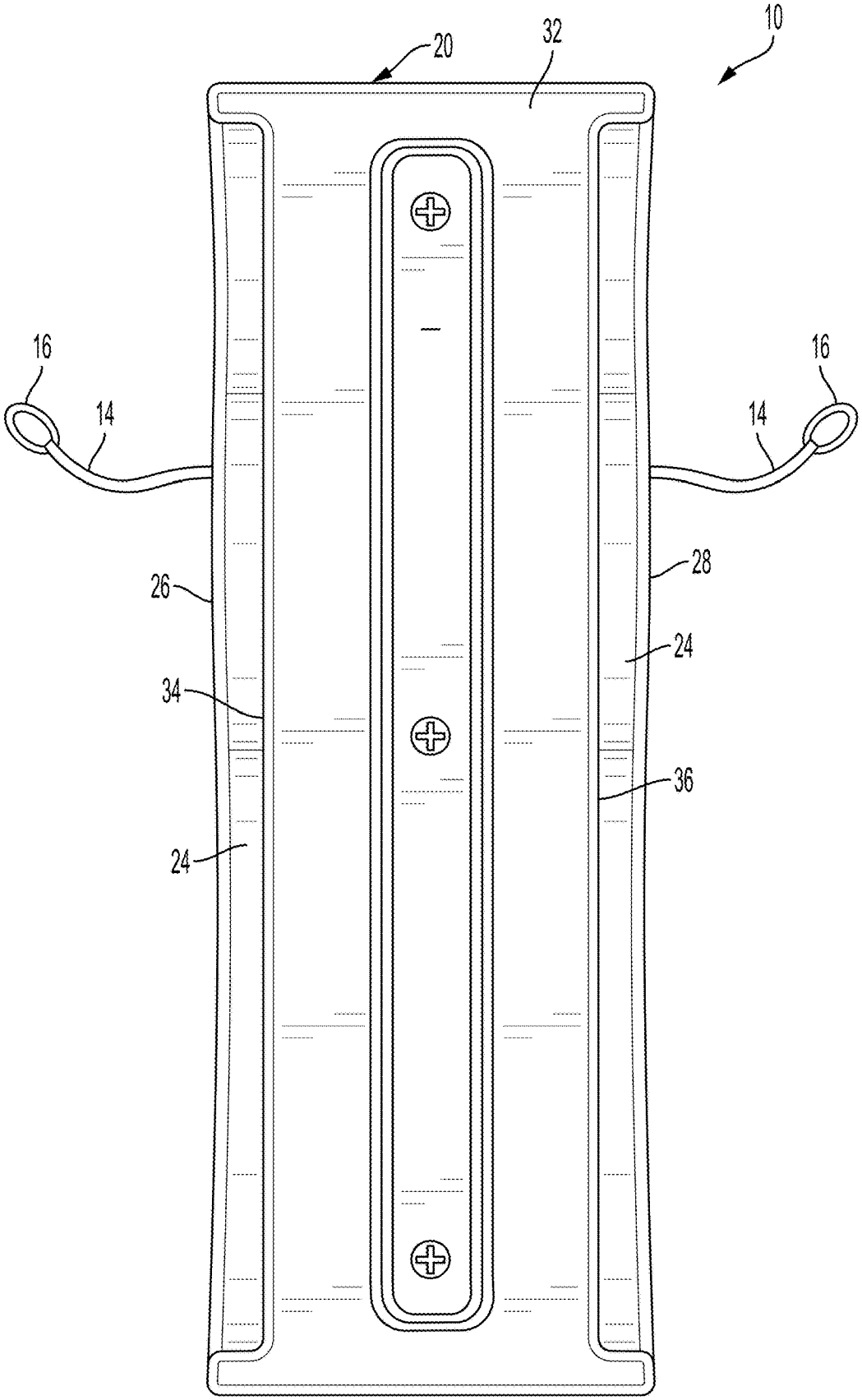
FIG. 4 is a bottom view of the embodiment of FIG. 1

FIGS. 1-4 illustrate various example views of a first embodiment of an exercise system 10. FIG. 1 is a perspective view of an exercise system 10, FIG. 2 is a side view of the exercise system 10, FIG. 3 is a top down view of the exercise system 10, and FIG. 4 is a bottom view of the exercise system 10. In various embodiments, exercise system 10 comprises a body 12; a plurality of apertures 48 that extend through a sidewall of the body 12; and a plurality of flexible bands 14 each having a loop or grip element 16 secured to an end thereof. In various embodiments, grip element 16 may be a handle, bar, strap, or brace for securing to any part of the body, e.g., hands, feet, hips, calves, forearms, etc.

In the example embodiment, the body 12 provides a supporting surface for an end user (consumer) while the user performs exercises. For example, the user may pull on both of the grip elements 16 while the flexible band is secured within the aperture 48 to extend the elastic band 14 (see FIGS. 36-38). In this example, the apertures 48 provide a bearing surface capturing the flexible band 14 therein. In various embodiments, the body 12 can be formed, for example, from a suitable material strong enough to support the weight of the user, but light enough to permit the body 12 to be carried and moved by one or two people without undue effort. In various embodiments, the body 12 is formed of a unitary or monolithic component. In various embodiments explained below, the body 12 may be formed from multiple components having various material properties, e.g., rigidity, density, flexibility, etc.

In at least the embodiment of FIGS. 1-4, the body 12 incudes a top portion 18 and a bottom portion 20. The top portion 18 has a curved upper surface 22, and a curved lower surface 24. The top portion 18 further includes a first side surface 26, and a second side surface 28 opposite the first side surface. The first and second side surfaces 26, 28 each adjoin the upper surface 22 and the lower surface 24, for example. An upper surface of the bottom portion 20 may adjoin and support the lower surface 24 of the top portion 18. In the example embodiment, the bottom portion 20 has a planar lower surface 32 that serves as a bearing surface for the exercise system 10 when in use. For example, the planar lower surface 32 supports the exercise system 10 and contacts the floor during normal use of the exercise system 10.

In various embodiments, the bottom portion 20 also includes a first side surface 34 and a second side surface 36 opposite the first side surface 34. The first and second side surfaces 34, 36 each adjoin the top portion 18, and the lower surface 32, for example. In various embodiments, the first side surface 34 and second side surface 36 may be recessed in relation to the first side surface 26 of the top portion 18, for example as can be seen in FIG. 1.

In the example embodiment, the bottom portion 20 has a plurality of apertures 48 formed therein. In the example embodiment, four apertures 48 are formed therein and extend through side surface 34, 36 of the bottom portion 20 in a widthwise direction and serve as a passageway for bands 14. In various embodiments, apertures 48 may be reinforced with a tube or conduit, e.g., a PEEK or PVC pipe. However, other embodiments may have more or less apertures 48. In various embodiments, each aperture 48 extends transversely across the bottom portion 20 and the cavity 40, between the first and second side surfaces 34, 36. In the example embodiment, apertures 48 have a relatively consistent internal diameter and are each disposed at approximately the same height above bottom surface 32, i.e., with respect to bottom surface 32. In various embodiments, the apertures 48 provide the user with access to the bands 14. Additionally, an end user may slip any form of bands 14 of various elastic strength through apertures 48 to customize a resistance level for a particular end user or exercise regimen, for example In various embodiments, the upper surface 22 of the top portion 18 has a wave like curvature visible in FIGS. 1 and 2. For example, the upper surface 22 has a wave like shape comprising a first peak portion tailoring into a trough portion tailoring into another peak portion. In this embodiment, the second peak portion is relatively shorter than the first peak portion. In particular, the upper surface 22 has an outwardly curved first portion 52*a* (peak portion) that forms a forwardmost part of the upper surface 22, and an outwardly curved second portion 52*b* (peak portion) that forms the rearwardmost part of the upper surface 22. The upper surface 22 also has an inwardly curved third portion 52*c* (trough portion) that adjoins, and is located between the first and second portions 52*a*, 52*b*. The user can stand, sit, kneel or lie on the upper surface when performing a variety of different exercises using the bands 14 (see FIGS. 36-38).

The above explained contours of the upper surface 22 may be selected so that the upper surface 22 provides optimal support to the user when the user is lying face up on the body 12, for example it provides support to the spine and/or back. More specifically, and by way of example, the first portion 52*a* can support the head, neck, and back of the user, with the outward curve of the first portion 52*a* allowing the user's neck to remain in a natural position that helps to minimize stress on the cervical spine and the associated musculature, enhancing user comfort and reducing the chances of injury. The inward curvature of the third portion 52*c* supports the user's lower back and hips in a manner that supports the lower back in a natural curvature that reduces stress on the lumbar spine and the associated musculature.

The outward curvature of the second portion 52*b* may support the user's legs in a manner that allows the legs to bend at the knees, further reducing stress on the lumbar spine.

Figure 5:
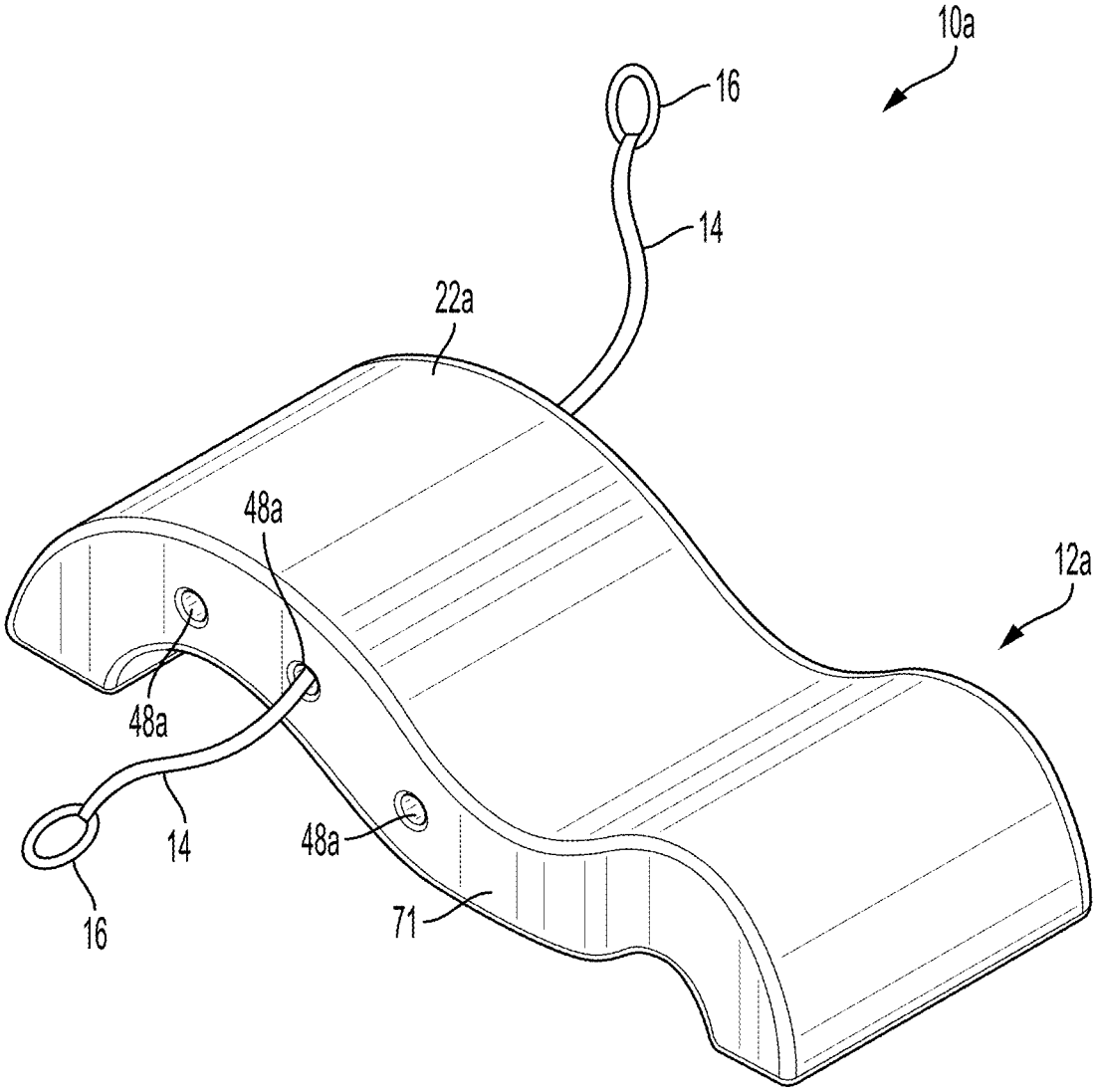
FIG. 5 is a perspective view of an exercise system.
Figure 6:
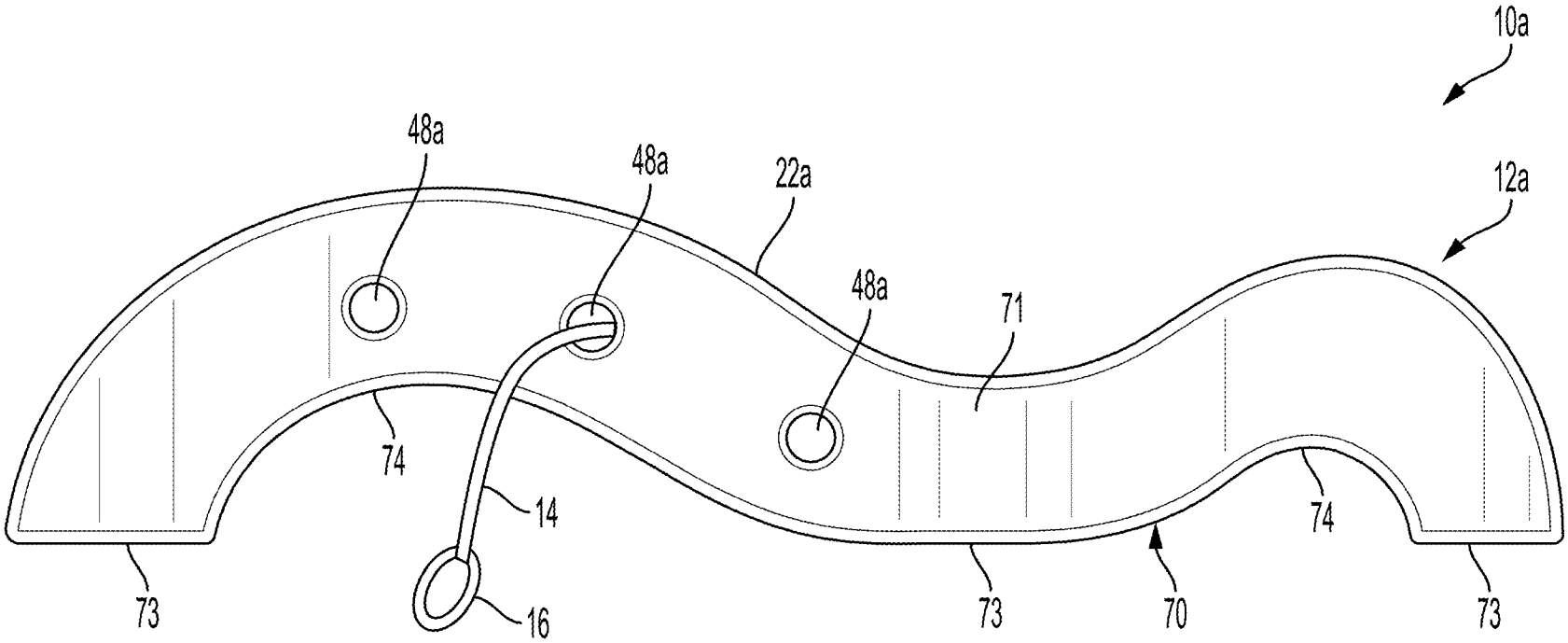
FIG. 6 is a side view of the embodiment of FIG. 5.
Figure 7:
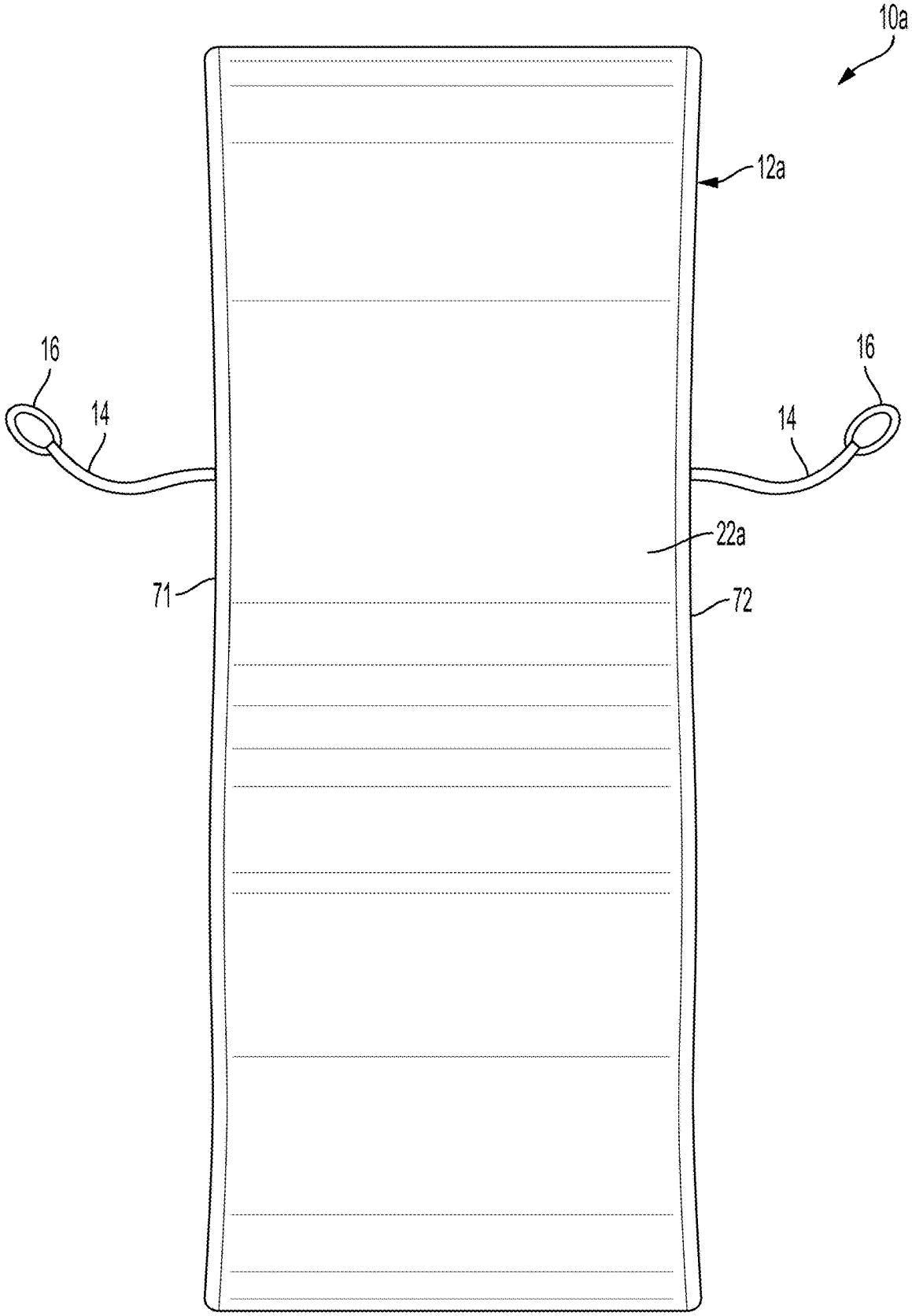
FIG. 7 is top view of the embodiment of FIG. 5
Figure 8:
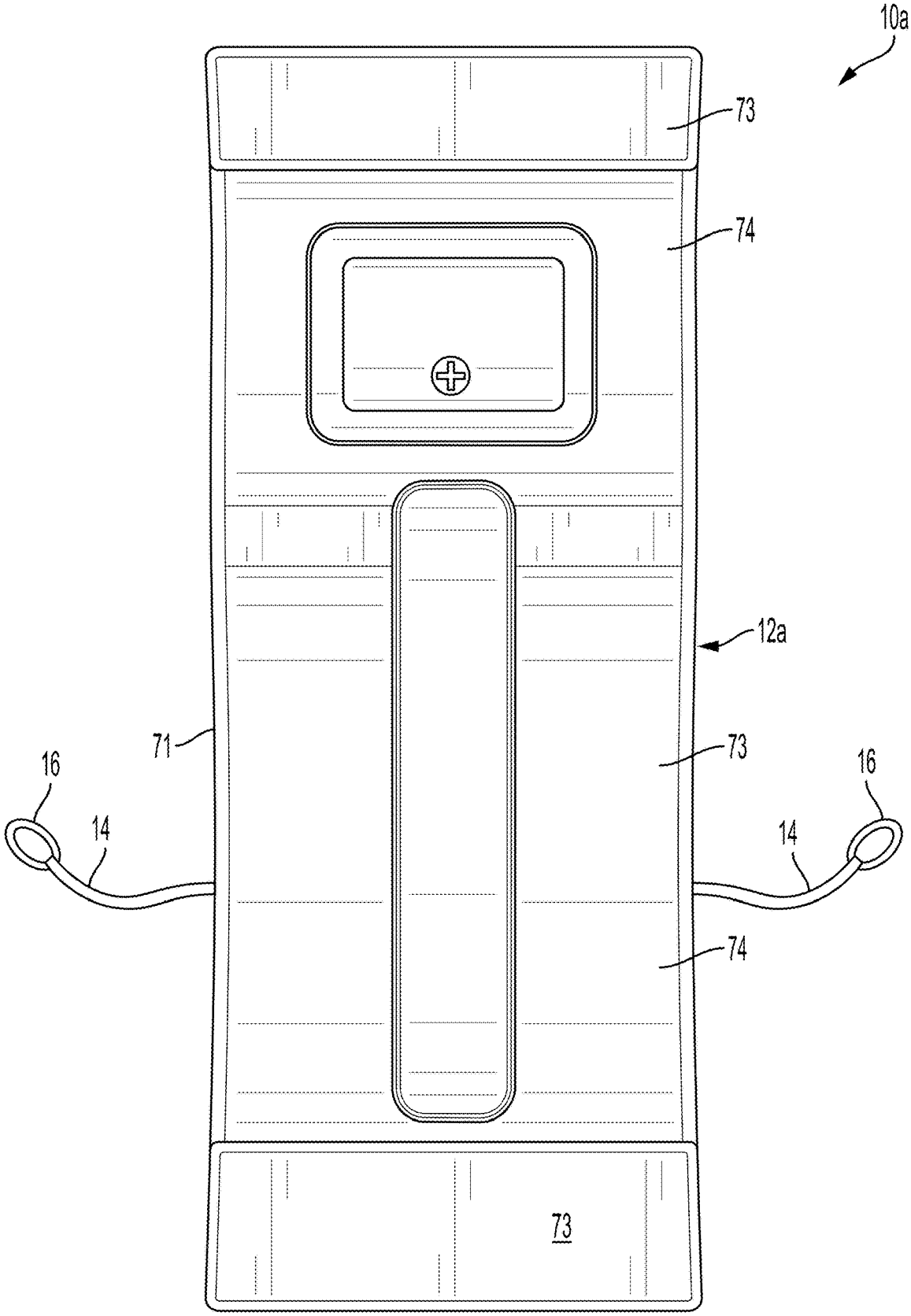
FIG. 8 is a bottom view of the embodiment of FIG. 5

FIGS. 5-8 illustrate various example views of a second embodiment of an exercise system 10*a*. FIG. 5 is a perspective view of a second embodiment of an exercise system 10*a*, FIG. 6 is a side view of the embodiment of FIG. 5, FIG. 7 is top view of the embodiment of FIG. 5, and FIG. 8 is a bottom view of the embodiment of FIG. 5. This second embodiment of exercise system 10*a* is similar to exercise system 10*a*. Accordingly duplicative description will be omitted and like numbering will be used where possible. In the example embodiment, exercise system 10*a* may be formed of a single foam component, i.e., a single unitary component without a supporting base like the embodiment of FIGS. 1-4, for example. In the example embodiment, body 12*a* may be supported by substantially rigid ends 73. Additionally, bands 14 may extend through apertures 48*a* of body 12*a* in the widthwise direction. In the example embodiment, apertures 48*a* are disposed at different relative heights above a bottom most surface of rigid ends 73. This may have the advantage of positioning various bands 14 in different configurations suitable for exercising different muscle groups from different positions.

Similarly as explained above, each band 14 has a grip 16 attached to each end of the band 14. The band 14 can be installed on the body 12 by passing one end of the band 14, and the associated grip 16, through one of the apertures 43*a*, so that the grip 16 and the attached end of the band 14 emerge from the other side of the body 12. In some embodiments, grips 16 may be detachable, e.g., by hooks and/or clips. The user can then grasp the two grips 16 on the opposite ends of the band 14. Because the grips 16 and the ends of the band 14 are located on opposite sides of the body 12, the band 14 is restrained by the body 12 as the user moves the grips 16 away from the body 12. The elasticity of the band 14 causes the band 14 to exert a resistive force that increases progressively as the band 14 is stretched. The user can vary the resistive force by swapping a particular band 14 with another band 14 having greater or lesser elasticity, i.e., by another band 14 that exerts a greater, or lesser resistive force for a given amount of extension and/or deflection.

In this embodiment, the form of body 12*a* includes an upper surface 22*a* having a shape that is substantially similar to that of the upper surface 22 of the body 12*a* of FIGS. 1-4, for example. The body 12*a* may include a lower surface 70 having substantially planar or flat rigid ends 73 upon which the body 12*a* rests during normal use. The body 12*a* may also include inwardly curved portions 74 disposed between the flat portions 73. In this embodiment, the inwardly curved portions 74 are not directly supported underneath and are rather indirectly supported by ends 73. In various embodiments, the body 12*a* may have a plurality of apertures 48*a* formed therein. For example, apertures 48*a* may serve as passageways that extend between first and second side surfaces 71, 72 of the body 12*a*. The apertures 48*a* may accept elastic bands 14 so that the user can manipulate the bands 14 to perform exercises in a manner similar to that discussed above in relation to the embodiment of FIGS. 1-4 and discussed in detail in relation to FIGS. 36-38. Alternative embodiments of the body 12*a* can be formed with more, or less than three apertures 48*a*.

Figure 9:
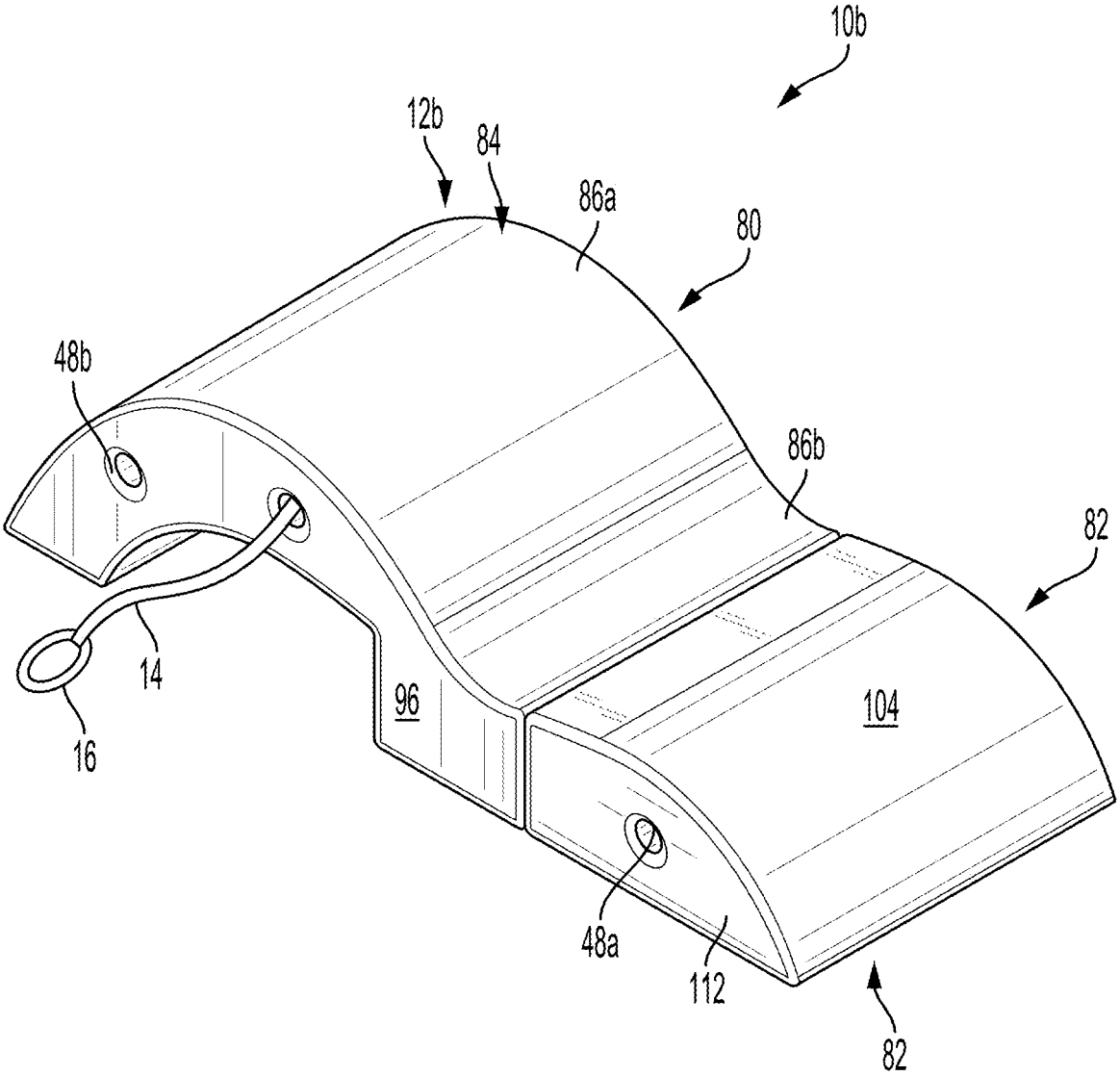
FIG. 9 is a perspective view of a collapsible exercise system.
Figure 10:
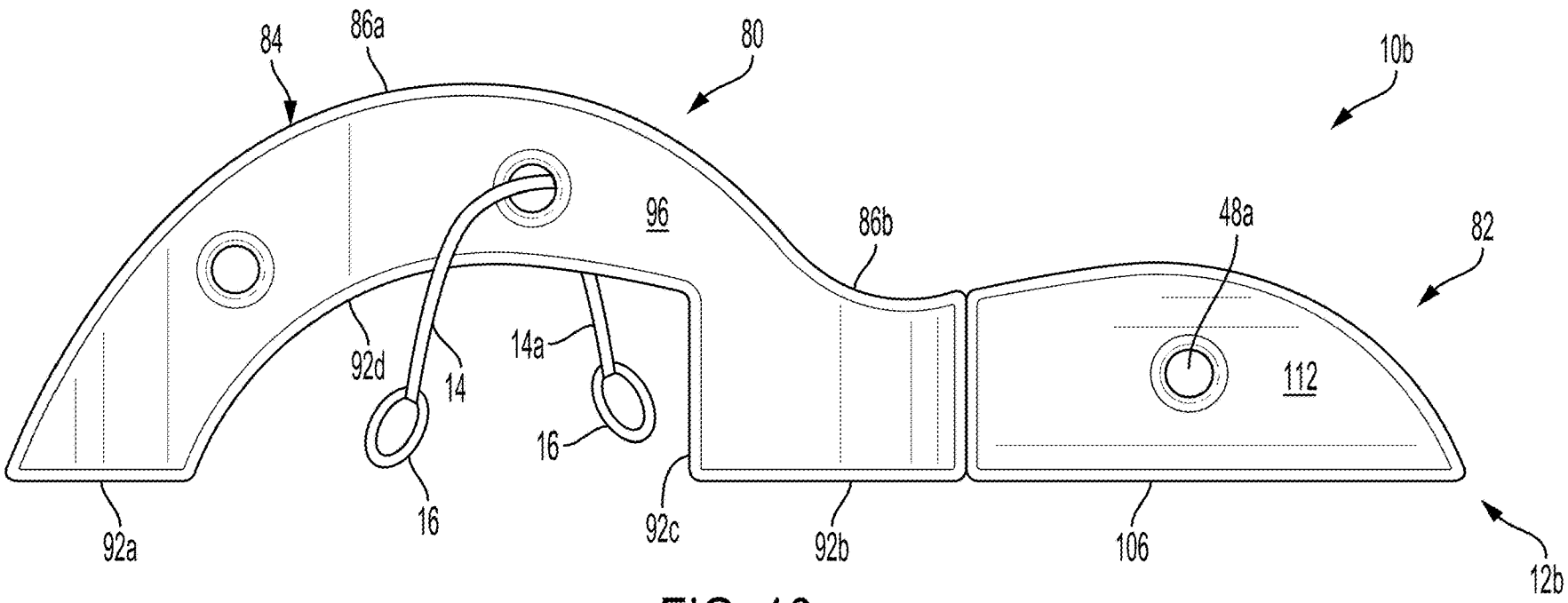
FIG. 10 is a side view of the embodiment of FIG. 9.
Figure 11:
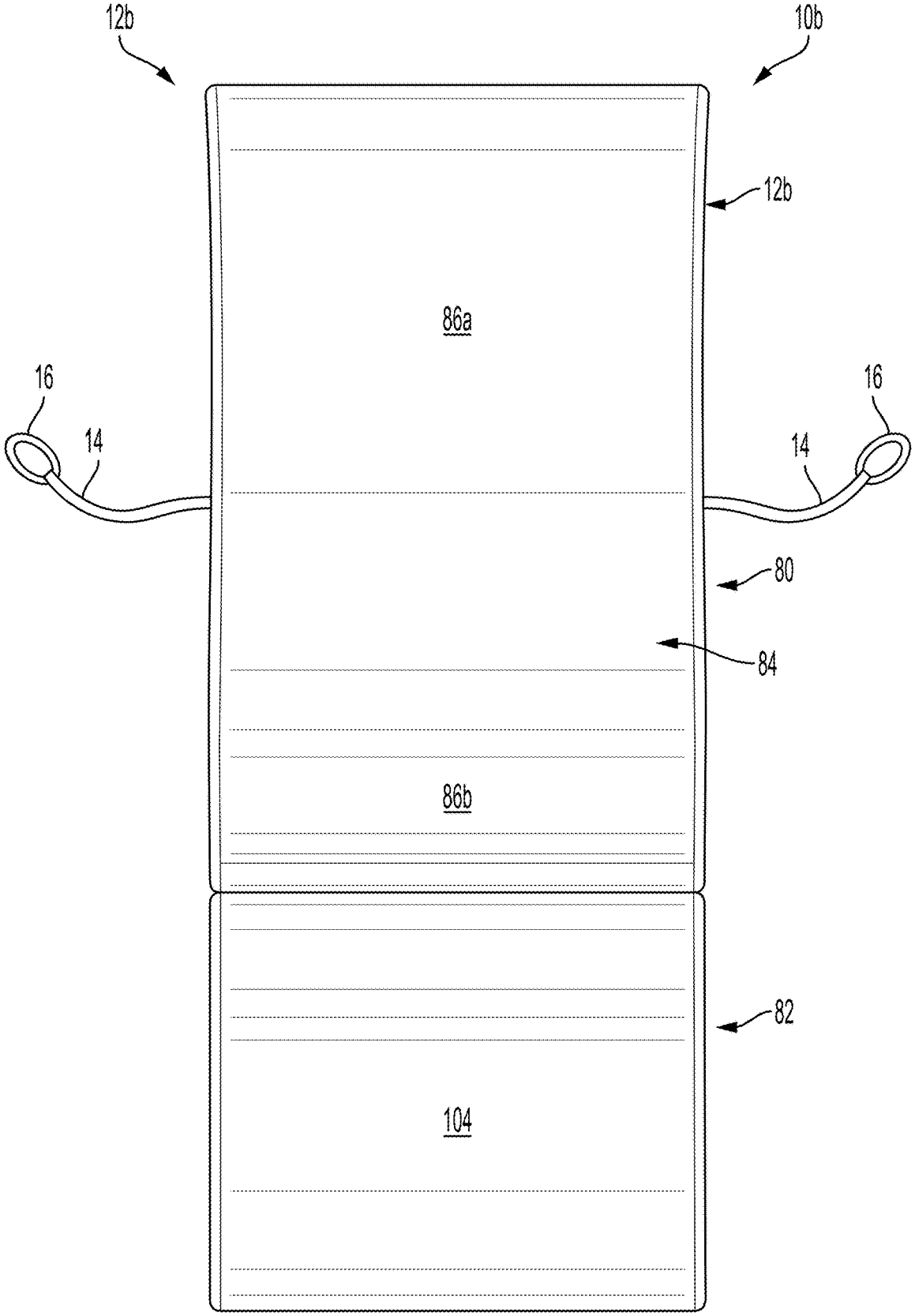
FIG. 11 is a top view of the embodiment of FIG. 9.
Figure 12:
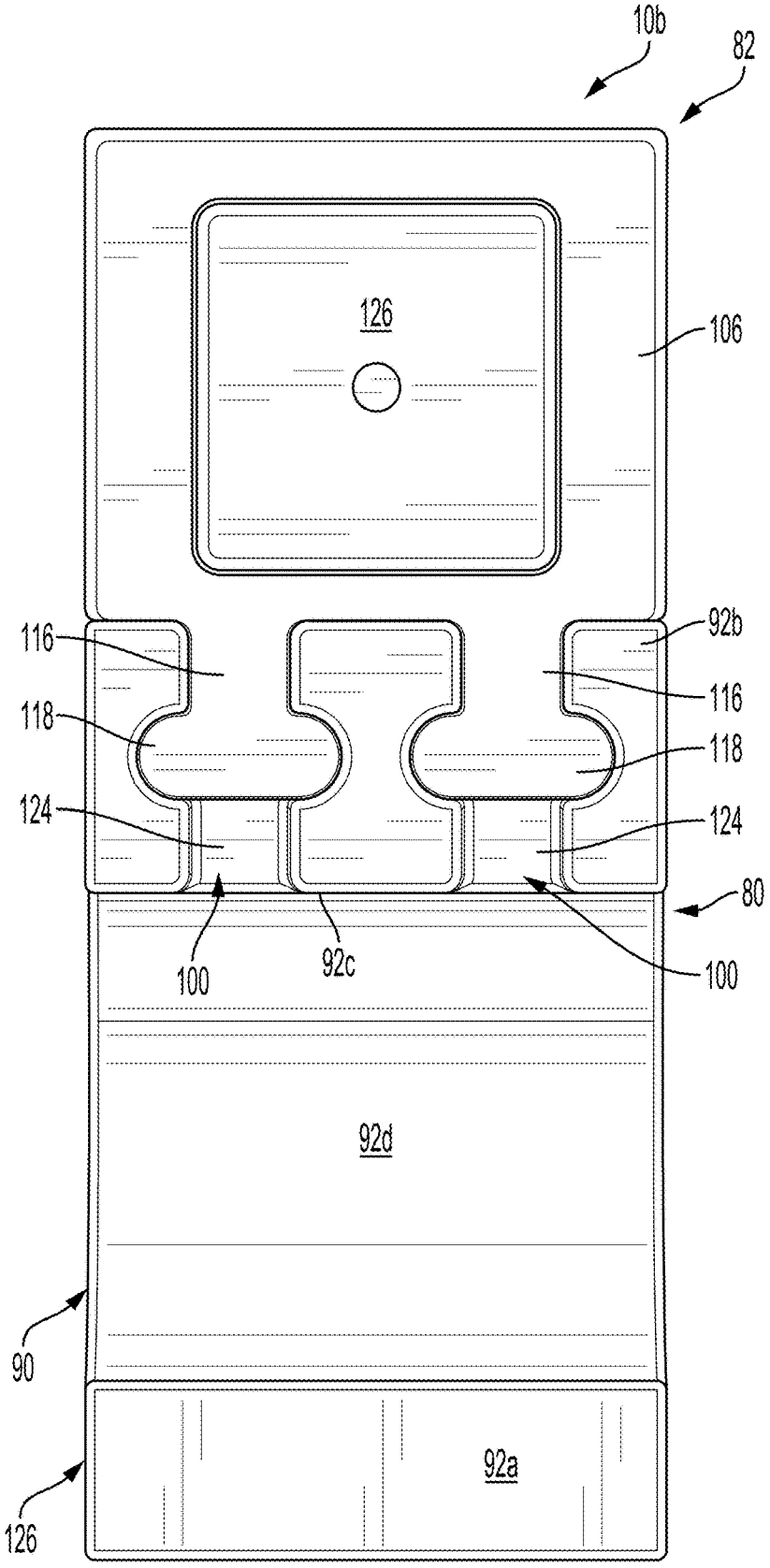
FIG. 12 is a bottom view of the embodiment of FIG. 9.

FIGS. 9-24 illustrate various example views of a third embodiment of a modular and collapsible exercise system 10*b*. FIG. 9 is a perspective view of a collapsible exercise system 10*b*, FIG. 10 is a side view of the embodiment of FIG. 9, FIG. 11 is a top view of the embodiment of FIG. 9, and FIG. 12 is a bottom view of the embodiment of FIG. 9. In the example embodiment, body 12*b* comprises a first portion 80, and a second portion 82 that is separable from the first portion 80. The first and second portions 80, 82 are configured so that the second portion 82 can be stored within the first portion 80 when the system 10*b* is not in use (see FIG. 22).

Referring to FIGS. 9-12, the first portion 80 comprises an upper surface 84 having an outwardly curved first portion 86*a* and an adjoining inwardly curved second portion 86*b*. In various embodiments, the first portion 80 also includes a substantially planar front surface 88, (see FIG. 17). The first portion 80 also includes a bottom surface 90. The bottom surface 90 comprises substantially planar first and second regions 92*a*, 92*b*, as shown in FIG. 12. The body 12*b* may rest on the first and second regions 92*a*, 92*b* during normal use of the exercise system 10*b*, for example. The second region 92*b* adjoins the front surface 88, and has a substantially perpendicular orientation in relation to the front surface 88. In various embodiments, the bottom surface 90 also includes a substantially planar third region 92*c*. The third region 92*c* adjoins the second region 92*b*, and has a substantially perpendicular orientation in relation to the second region 92*b*. The bottom surface 90 of the first portion 80 further includes a curved fourth region 92*d* that adjoins the first region 92*a* and the third region 92*c*. The third region 92*c* and the fourth region 92*d* define a cavity 94 that receives the second portion 82 of the body 12*a* when the second portion 82 of the body 12*b* is in its stowed configuration beneath the first portion 80, for example.

In various embodiments, the first portion 80 of the body 12*b* has at least one aperture 48*a* formed therein. In the example embodiment, two apertures 48*a* extend between first and second side surfaces 96, 98 of the first portion 80 in a widthwise direction. The apertures 48*a* accept the elastic bands 14, so that the user can manipulate the bands 14 to perform various exercises. Alternative embodiments of the first portion 80 can be formed with more, or less than two apertures 48*a*.

FIGS. 9-12 depict the second portion 82 of the body 12*b* in a deployed configuration in relation to the first portion 80. When the body 12*b* is in the deployed configuration, the upper surface 104 of the second portion 82 is located adjacent to the inwardly curved second portion 86*b* of the upper surface 84 of the first portion 80. The upper surface 84 of the first portion 80 and the upper surface 104 of the second portion 82 together support the user during use. The upper surface 84 and the upper surface 104 provide neck and lower back support for the user when the user is lying face up on the body 12*b*, in a manner similar to that discussed above in relation to the body 12.

Figure 13:
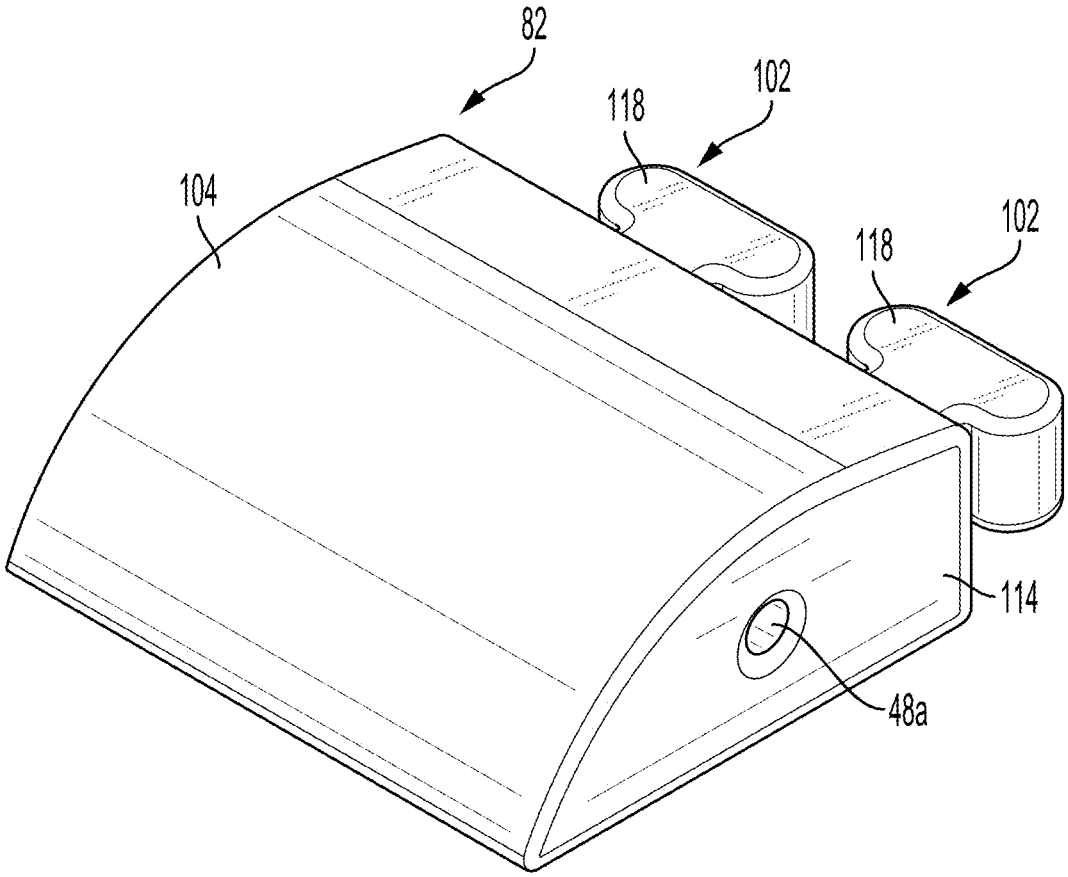
FIG. 13 is a perspective view of a portion of the embodiment of FIG. 9
Figure 14:
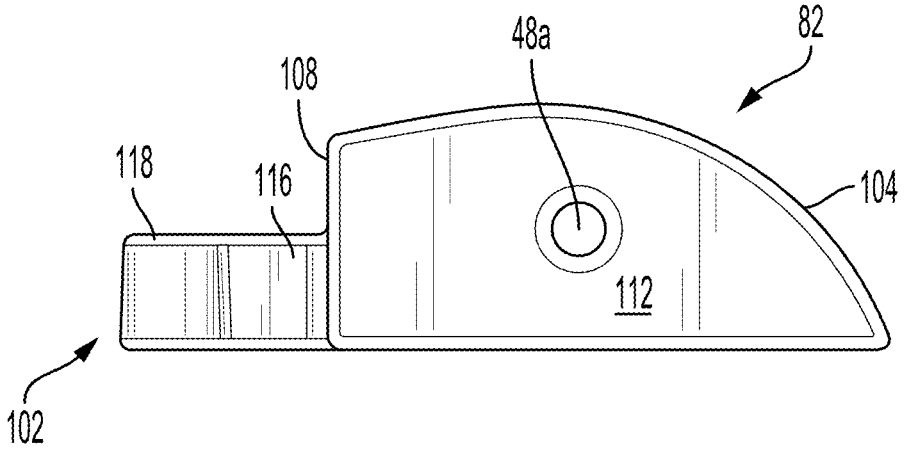
FIG. 14 is a side view of the embodiment of FIG. 13.
Figure 15:
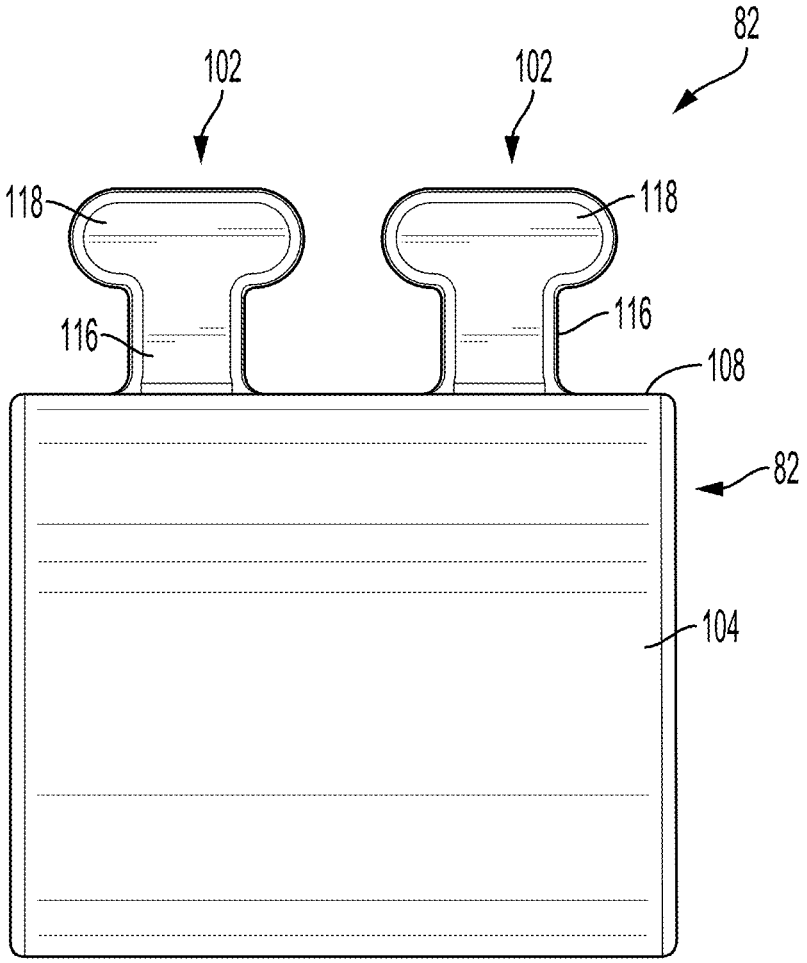
FIG. 15 is a top view of the embodiment of FIG. 13.
Figure 16:
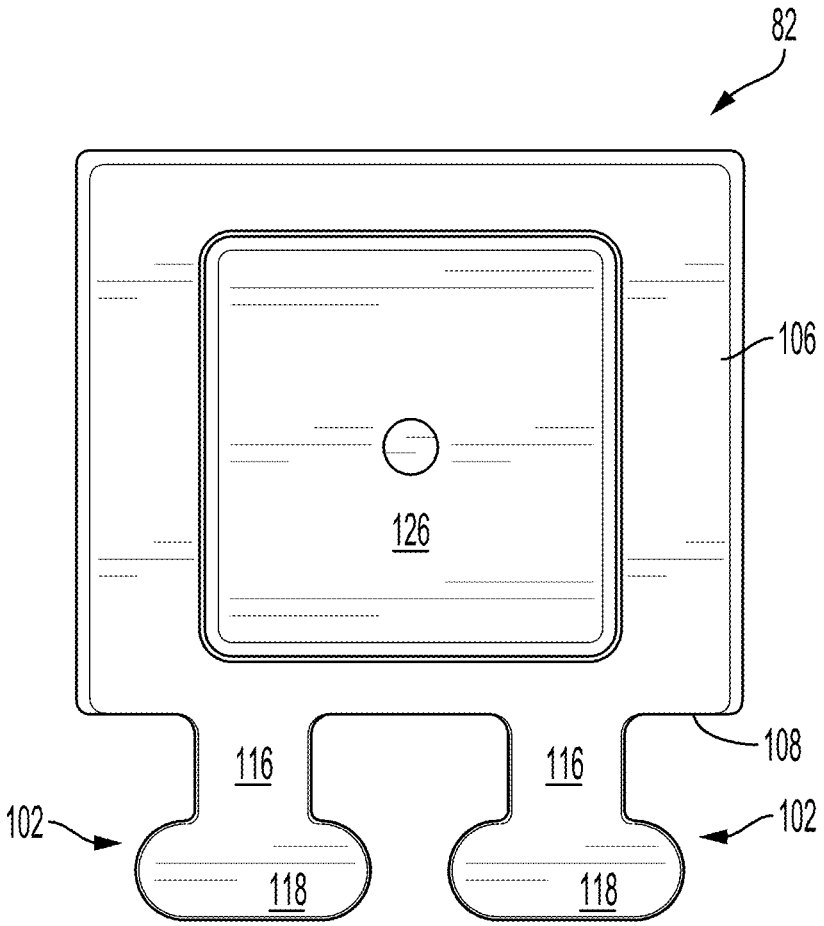
FIG. 16 is a bottom view of the embodiment of FIG. 13.

Referring to FIGS. 13-16, a second portion 82 is illustrated. FIG. 13 is a perspective view of the second portion 82 of the embodiment of FIG. 9, FIG. 14 is a side view of the embodiment of FIG. 13, FIG. 15 is a top view of the embodiment of FIG. 13, and FIG. 16 is a bottom view of the embodiment of FIG. 13. In the example embodiment of FIGS. 13-16, the second portion 82 of the body 12*b* has an outwardly curved upper surface 104, and a substantially planar bottom surface 106 that adjoins the upper surface 104. The second portion 82 also includes a substantially planar rear surface 108 that adjoins the upper surface 104 and the lower surface 106. The bottom surface 106 of second portion 82 rests on the floor during normal use.

In the example embodiment of FIGS. 13-16, the second portion 82 of the body 12*b* may have at least one aperture

48*a* formed therein and extending therethrough in a widthwise direction. The aperture 48*a* may extend between first and second side surfaces 112, 114 of the second portion 82. The aperture 48*a* is configured to accept and retain elastic bands 14 therein as explained previously. Alternative embodiments of the second portion 82 can be formed with more, or less than one aperture 48*a*, for example.

In the example embodiment of FIGS. 13-16, the mating arms 102 of the second portion 82 of the body 12*b* adjoin, and extend from the rear surface 108 of the second portion 82. Each mating arm 102 has a narrow portion 116, and a wide portion 118. Each narrow portion 116 has a substantially rectangular cross section, and adjoins the rear surface 108 of the second portion 82 as a first end of the narrow portion. Each wide portion 118 adjoins an associated one of the narrow portions 116 at a second end of the narrow portion 116. The wide portions 118 have a substantially oval shape, for example.

Figure 17:
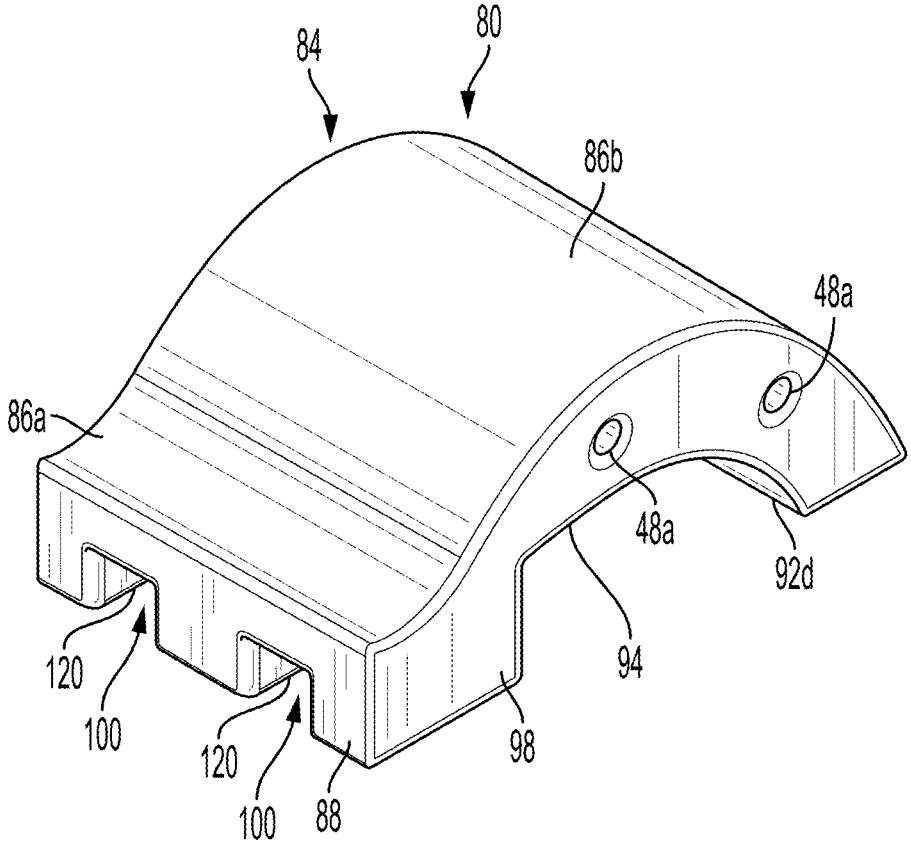
FIG. 17 is a perspective view of a portion of the embodiment of FIG. 9
Figure 18:
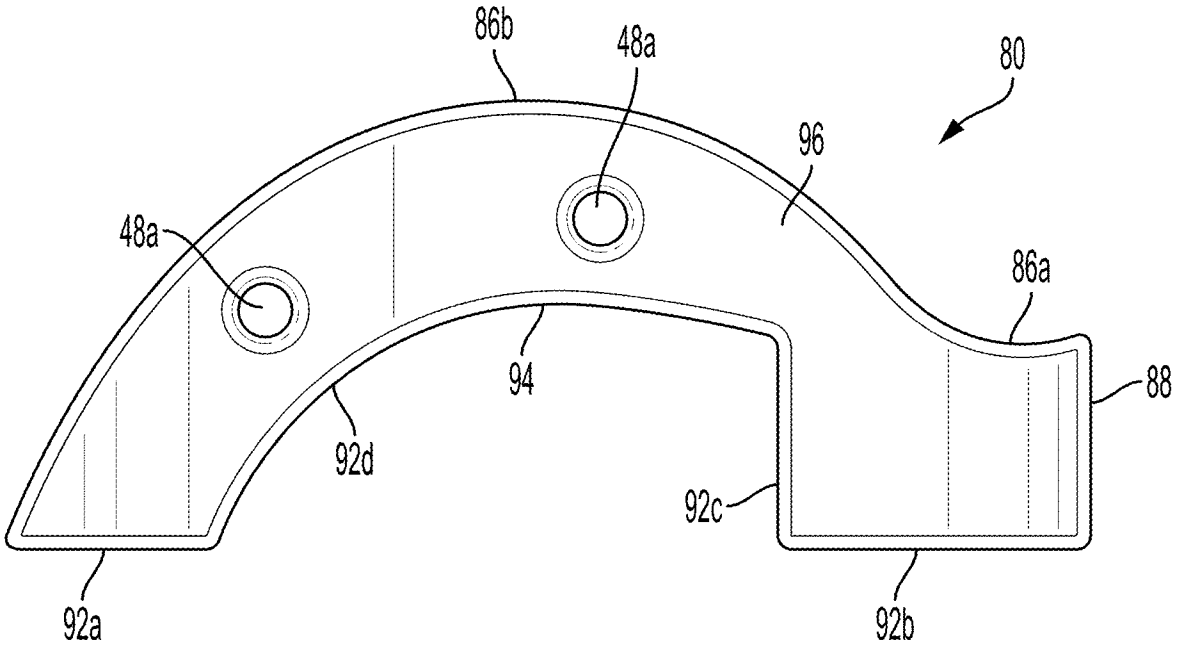
FIG. 18 is a side view of the embodiment of FIG. 17.
Figure 19:
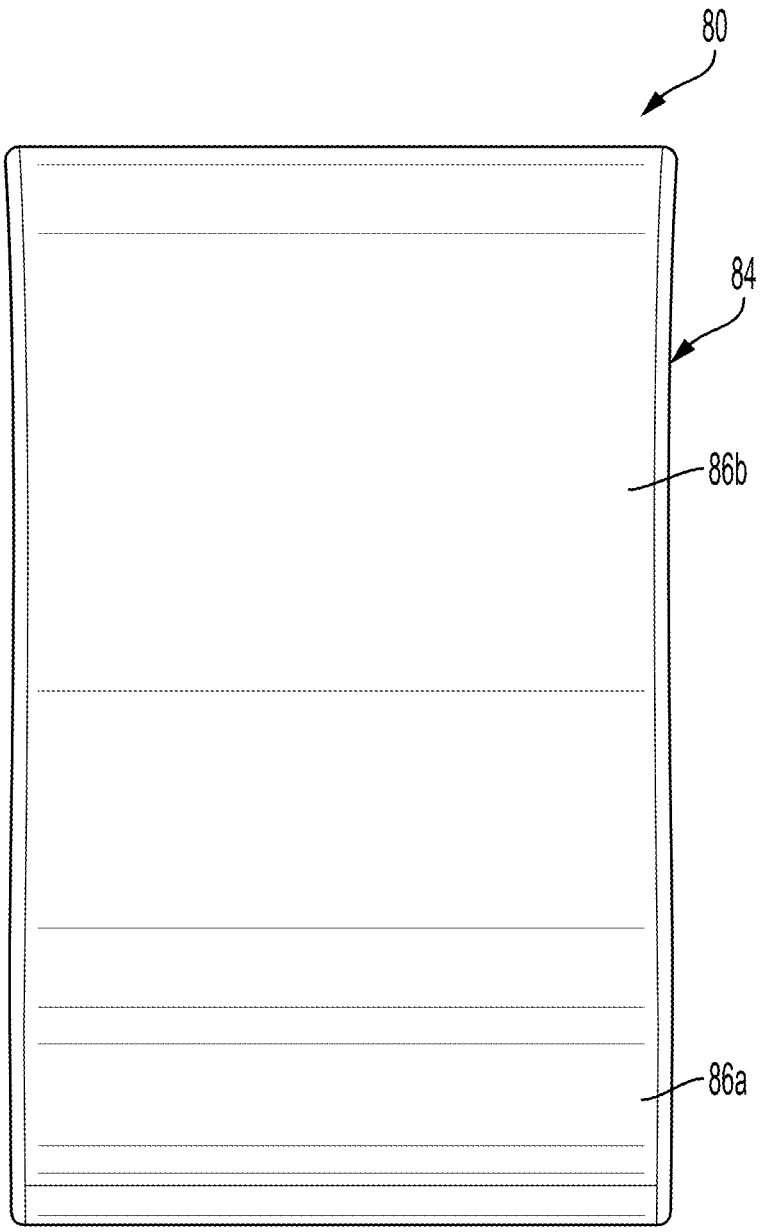
FIG. 19 is a top view of the embodiment of FIG. 17.
Figure 20:
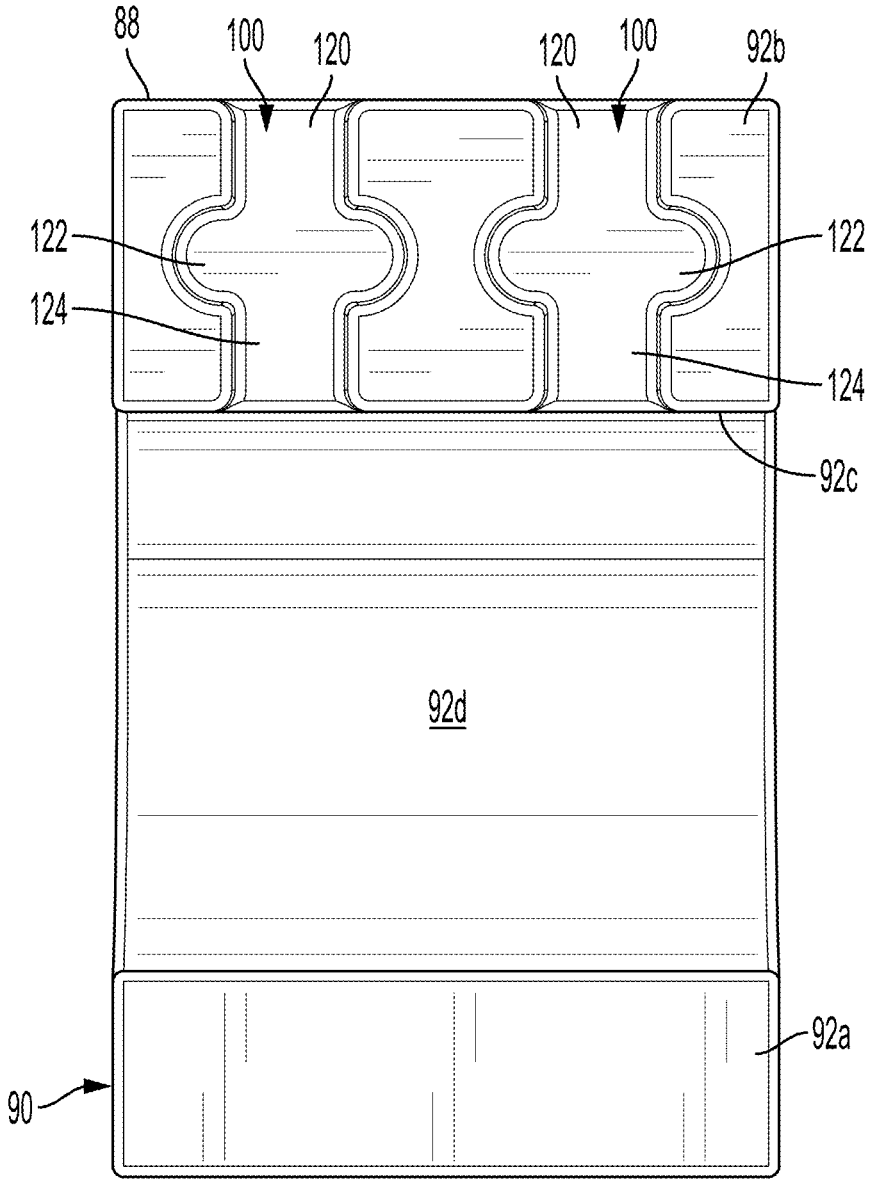
FIG. 20 is a bottom view of the embodiment of FIG. 17.

Referring generally to FIGS. 17-20 a first portion 80 is disclosed. FIG. 17 is a perspective view of a first portion 80 of the embodiment of FIG. 9, FIG. 18 is a side view of the embodiment of FIG. 17, FIG. 19 is a top view of the embodiment of FIG. 17, and FIG. 20 is a bottom view of the embodiment of FIG. 17. In the example embodiment, the first portion 80 has two substantially similar cavities 100 formed therein. Each cavity 100 is configured to receive a respective mating arm 102 of the second portion 82. The cavities 100 extend inward from the front surface 88, and from the second and third portions 92*b*, 92*c* of the bottom surface 90 of the first portion 80.

The minor cavities 100 in the first portion 80 of the body 12*b* are configured to receive the mating arms 102 when the second portion 82 of the body 12*b* is in its deployed configuration. In particular, each cavity 100 has a forward portion 120 that extends inward from the front surface 88 of the first portion 80; and an adjoining middle portion 122 that adjoins the forward portion 120, as shown in FIG. 20. The forward portion 120 and the middle portion 122 are sized so that the forward portion 120 and the middle portion 122 receive the respective narrow portion 116 and wide portion 118 of an associated the mating arm 102 with minimal clearance, when the second portion 82 of the body 12*b* is mated with the first portion 80, in the deployed configuration. The resulting interference between the adjacent surfaces of the mating arms 102 and the first portion 80 helps to retain the second portion 82 on the first portion 80, and to otherwise restrain the second portion 82 in relation to the first portion 80.

Figure 21:
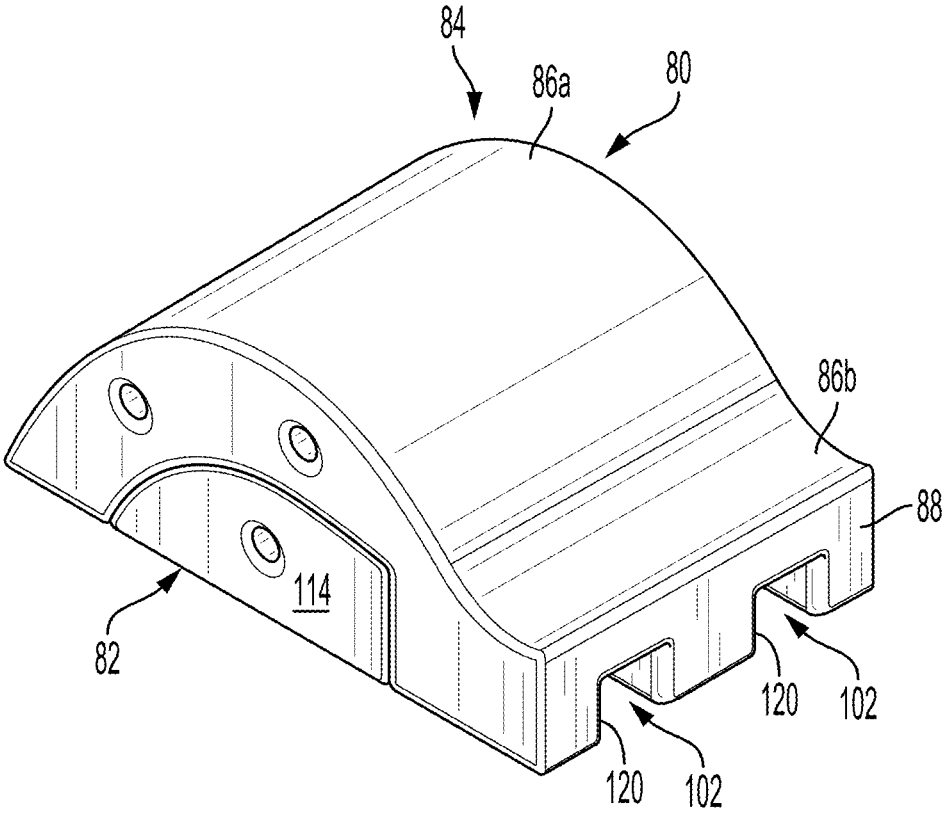
FIG. 21 is a perspective view of the embodiments of FIGS. 13 and 17 in a nested configuration.
Figure 22:
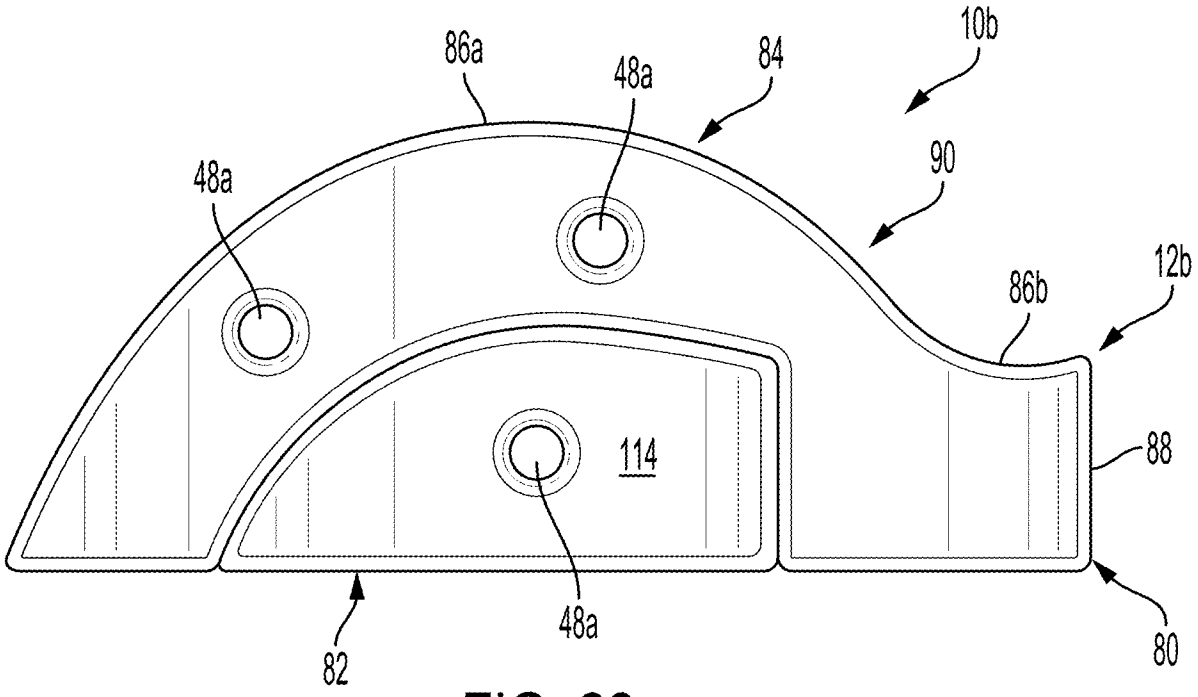
FIG. 22 is a side view of the embodiments of FIGS. 13 and 17 in a nested configuration.
Figure 23:
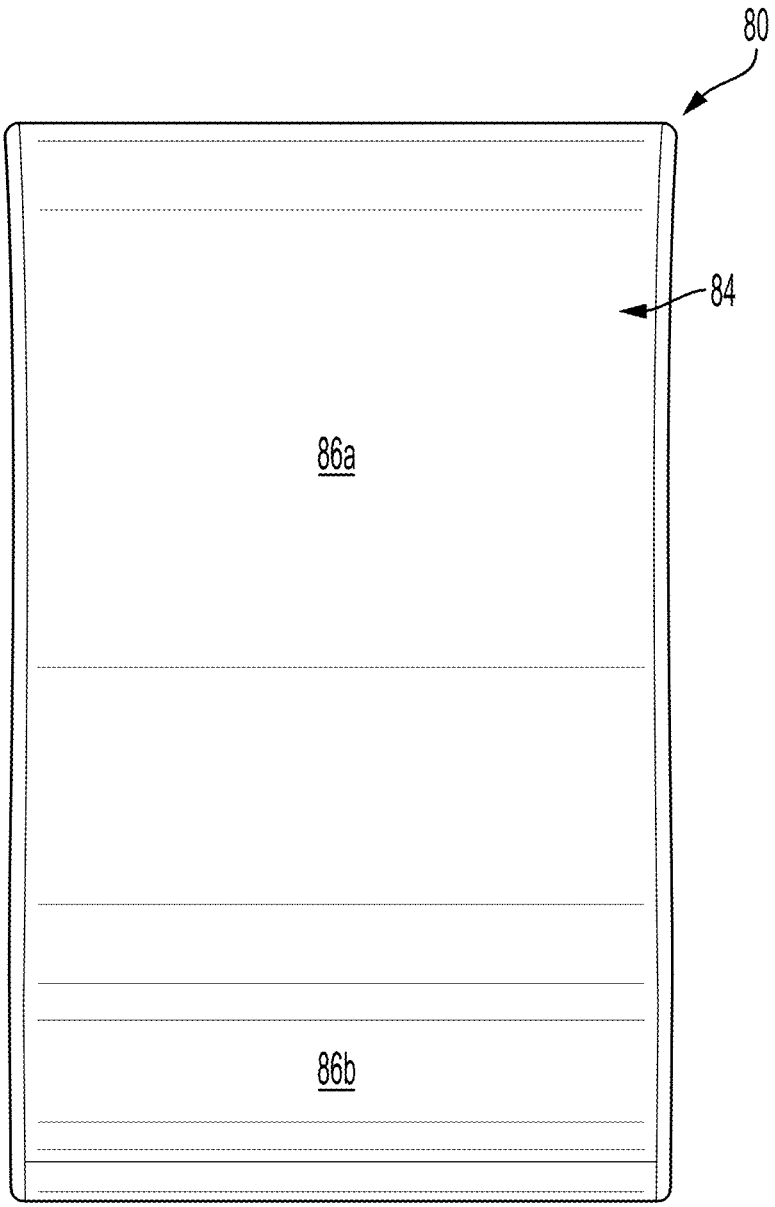
FIG. 23 is a top view of the embodiments of FIGS. 13 and 17 in a nested configuration.
Figure 24:
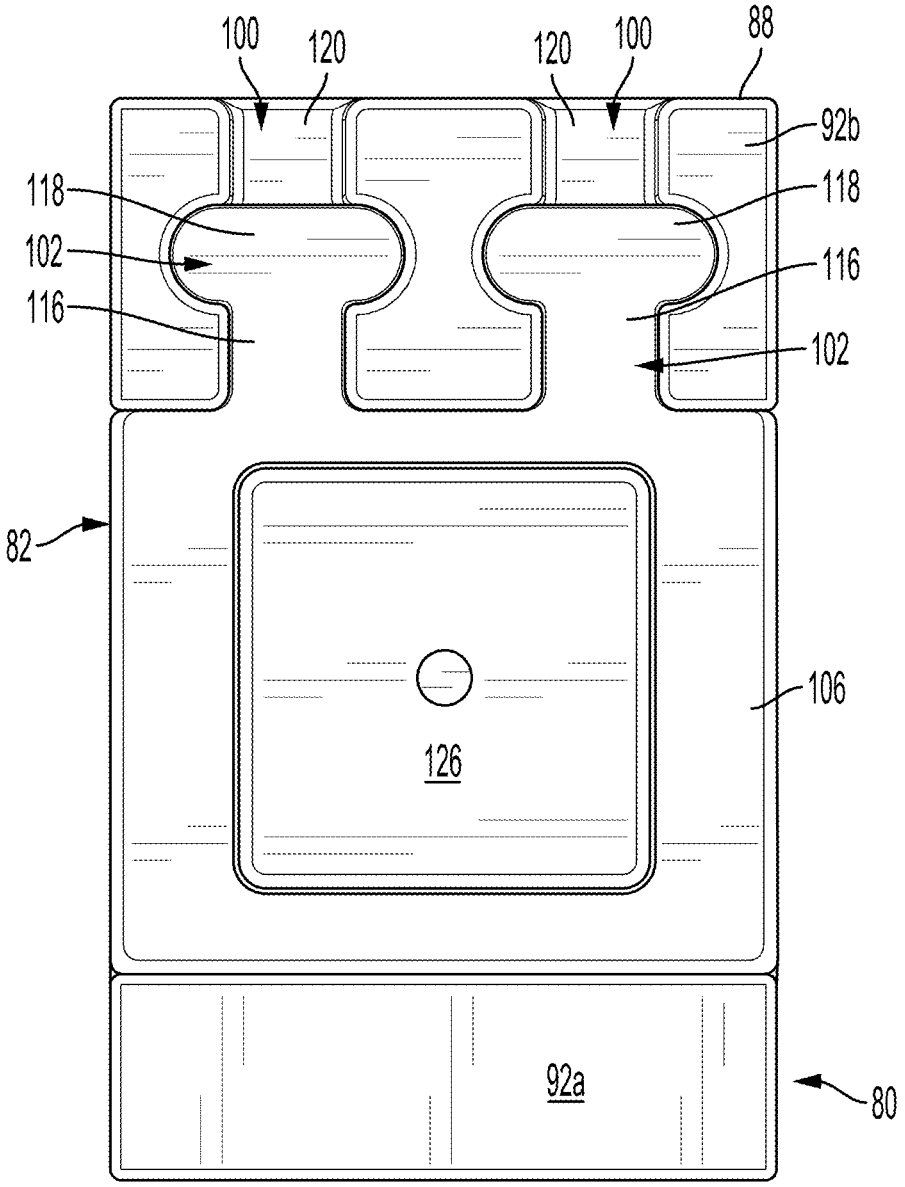
FIG. 24 is a bottom view of the embodiments of FIGS. 13 and 17 in a nested configuration.

Referring generally to FIGS. 21-24 the first portion 80 and second portion 82 of body 12*b* are shown in a nested configuration. For example, FIG. 21 is a perspective view of the embodiments of FIGS. 13 and 17 in a nested configuration, FIG. 22 is a side view of the embodiments of FIGS. 13 and 17 in a nested configuration, FIG. 23 is a top view of the embodiments of FIGS. 13 and 17 in a nested configuration, and FIG. 24 is a bottom view of the embodiments of FIGS. 13 and 17 in a nested configuration.

In the example embodiment of FIGS. 21-24 the second portion 82 of the body 12*b* may be in its nested position within the cavity 94 defined by the first portion 80, for example. Each minor cavity 100 may include a rearward portion 124 that adjoins the middle portion 122, and extends inward from the third portion 92*c* of the bottom surface 90 of the first portion 80, for example. The rearward portion 124 and the middle portion 122 may be sized to receive respective narrow portions 116 and wide portions 118 of an associated mating arm 102. For example, when the second portion 82 of the body 12*b* is mated with the first portion 80, in a nested configuration. At least one advantage of this nested configuration is that the body 12*b* may be stowed during periods of non-use in a relatively compact configuration. In various embodiments, the second portion 82 of the body 12*b* may also include a cavity (not shown) that may extend inward from the bottom surface 106 of the second portion 82. In various embodiments, the cavity may be used, for example, to stow one of more of bands 14 when bands 14 are not in use. In various embodiments, the cavity may be enclosed by a removable cover 126, for example.

Figure 25:
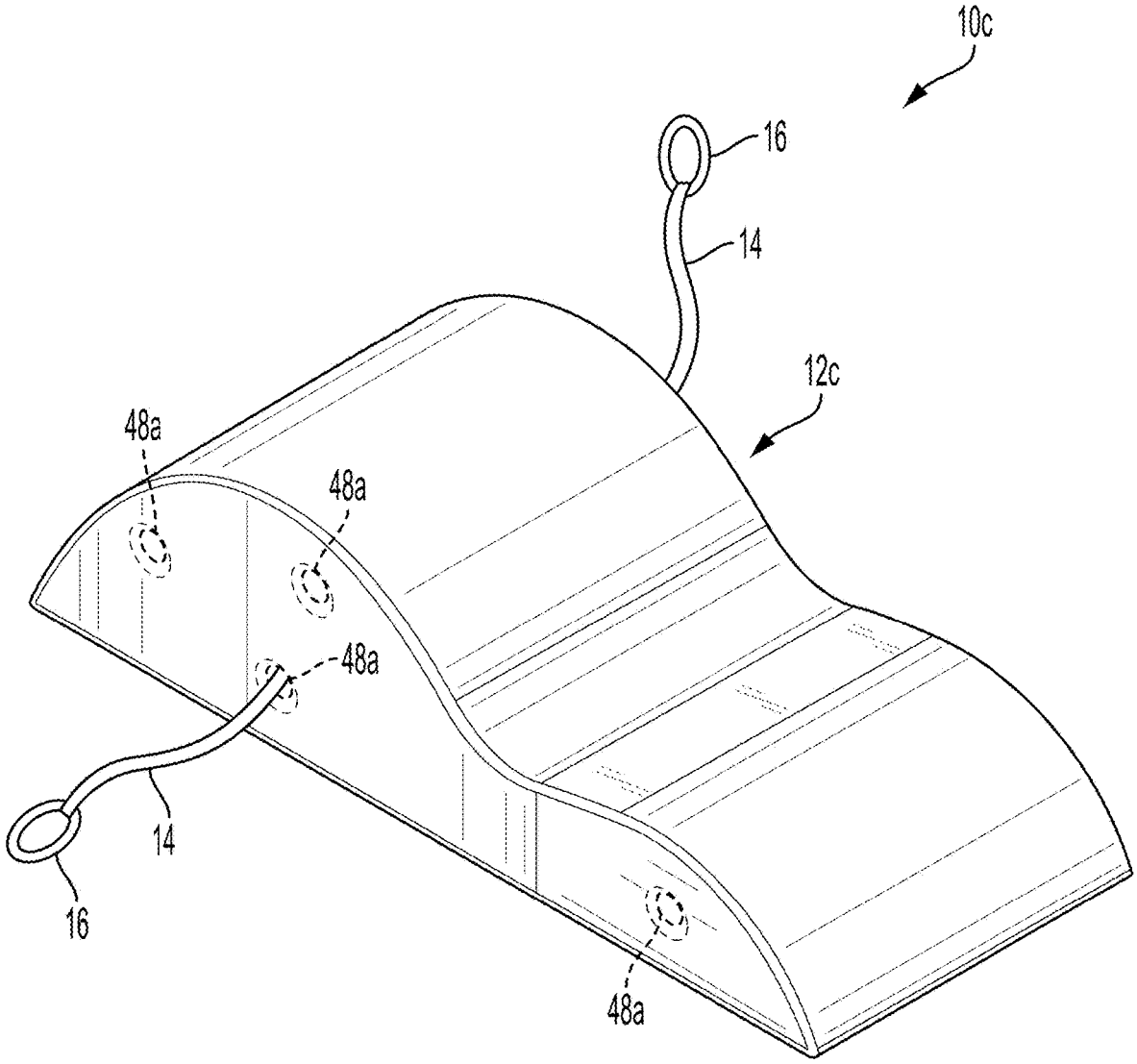
FIG. 25 is a perspective view of an exercise system.
Figure 26:
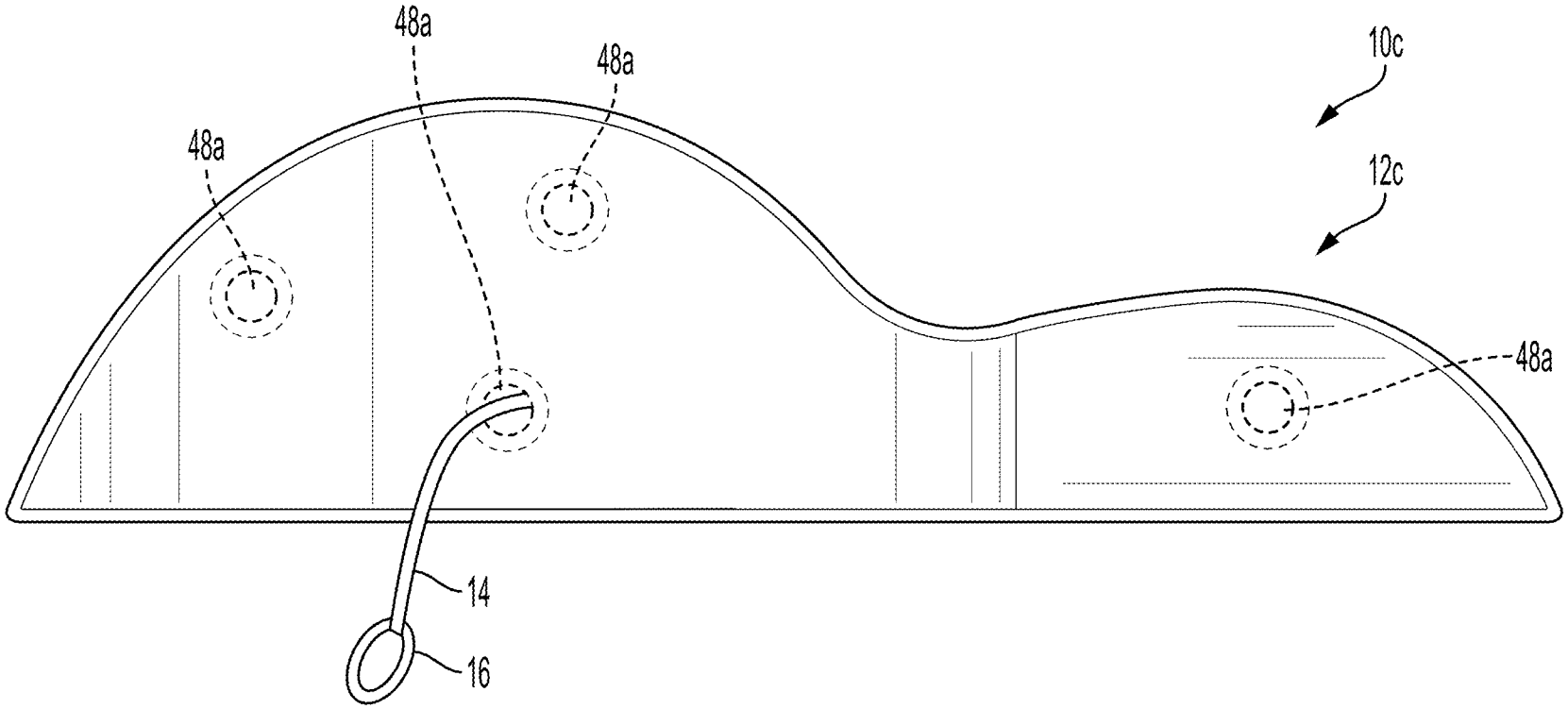
FIG. 26 is a side view of the embodiment of FIG. 25.
Figure 27:
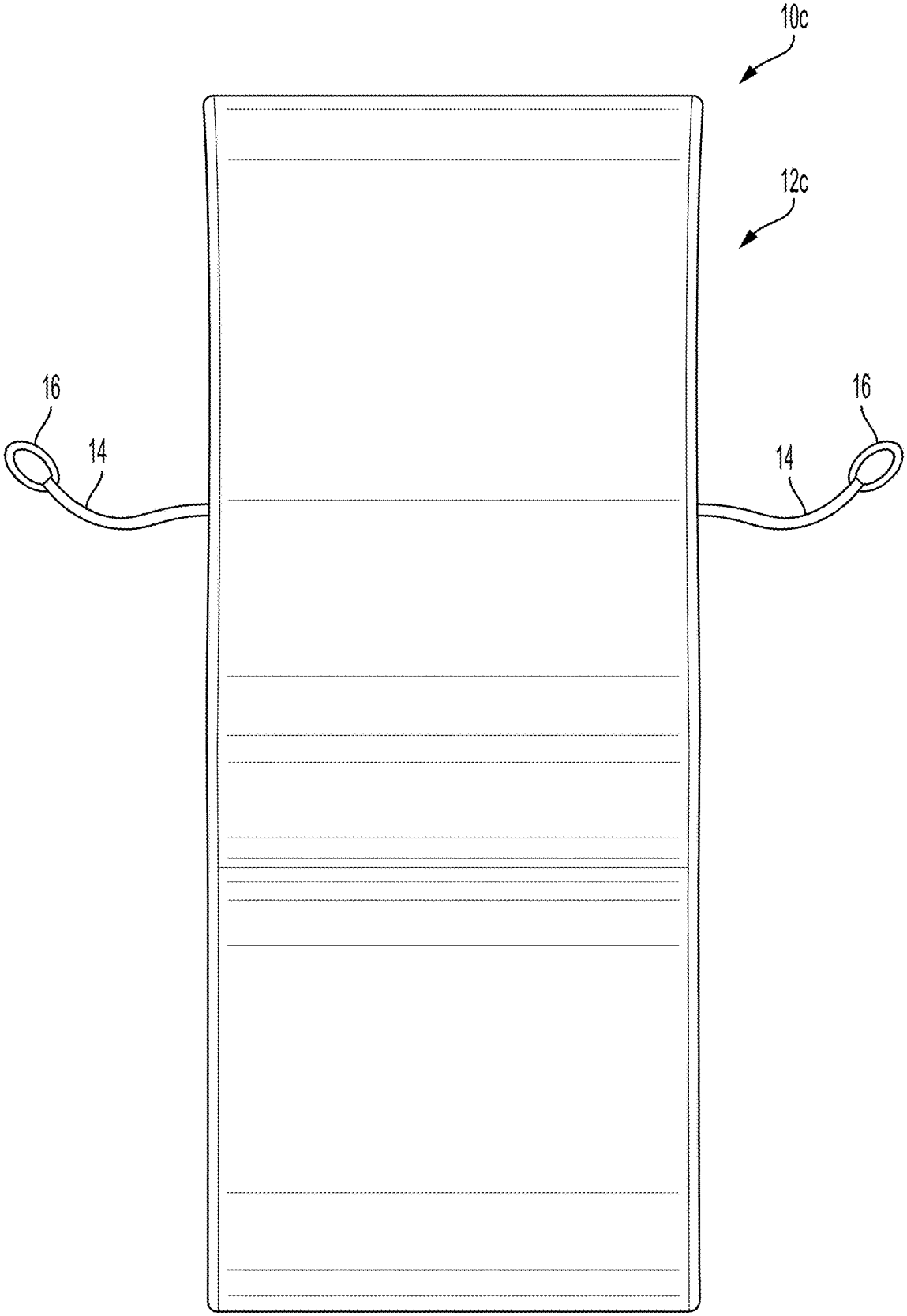
FIG. 27 is a top down view of the embodiment of FIG. 25.
Figure 28:
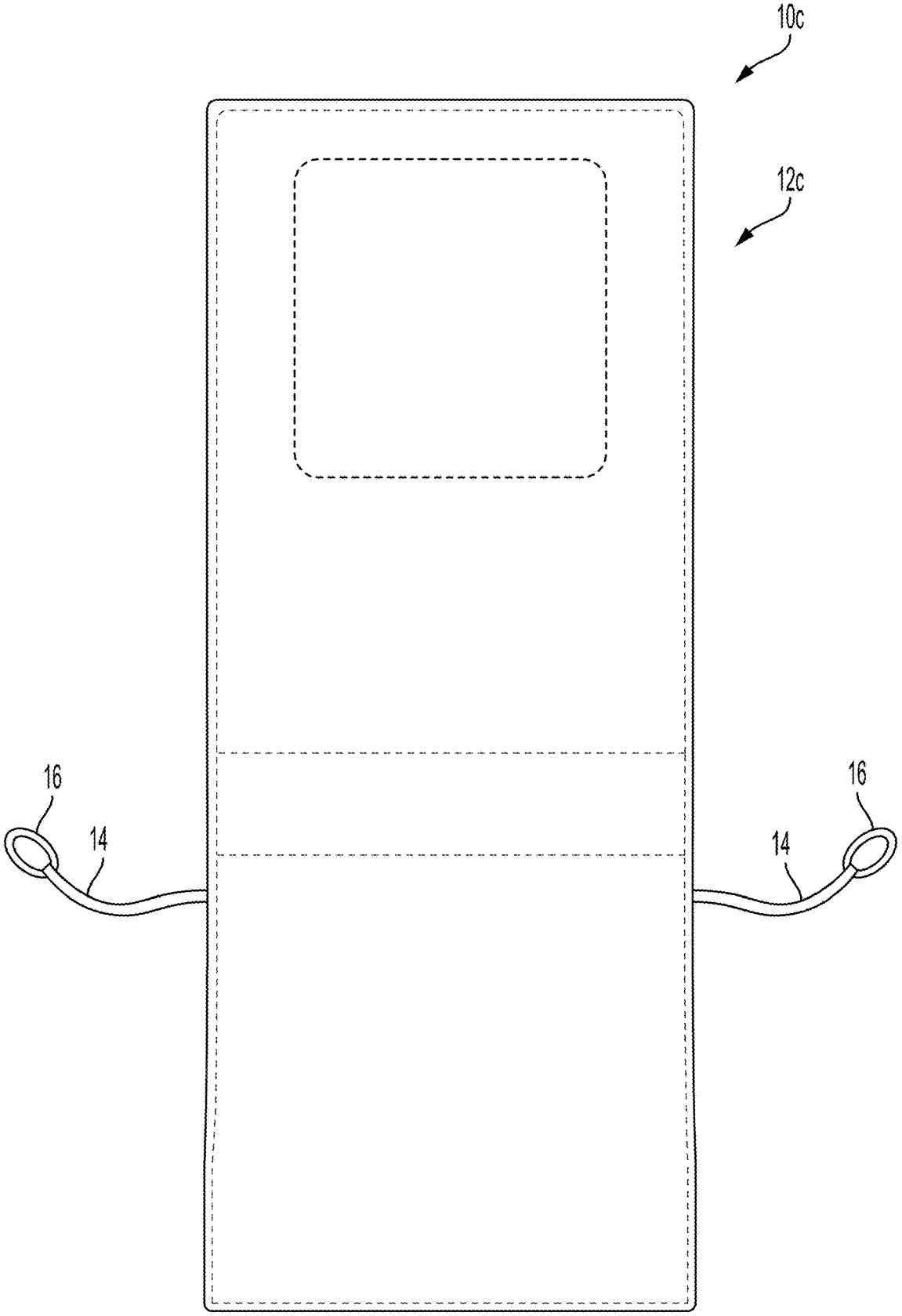
FIG. 28 is a bottom view of the embodiment of FIG. 25.

FIGS. 25-28 illustrate various views of a fourth embodiment of an example exercise system 10*c*. FIG. 25 is a perspective view of an exercise system 10*c*, FIG. 26 is a side view of the embodiment of FIG. 25, FIG. 27 is a top down view of the embodiment of FIG. 25, and FIG. 28 is a bottom view of the embodiment of FIG. 25. FIGS. 25-28 depict another alternative embodiment of an exercise system 10*c* in the form of a body 12*c*. The body 12*c* and the bands 14 together form an exercise system 10*c*. The body 12*c* has a shape that is substantially similar to body 12*b*, and includes a plurality of apertures 48*a*. Accordingly, duplicative description will be omitted. However, in this embodiment, the body 12*c* is formed as a single unitary piece, i.e., it does not separate into a first portion and a second portion.

Figure 29:
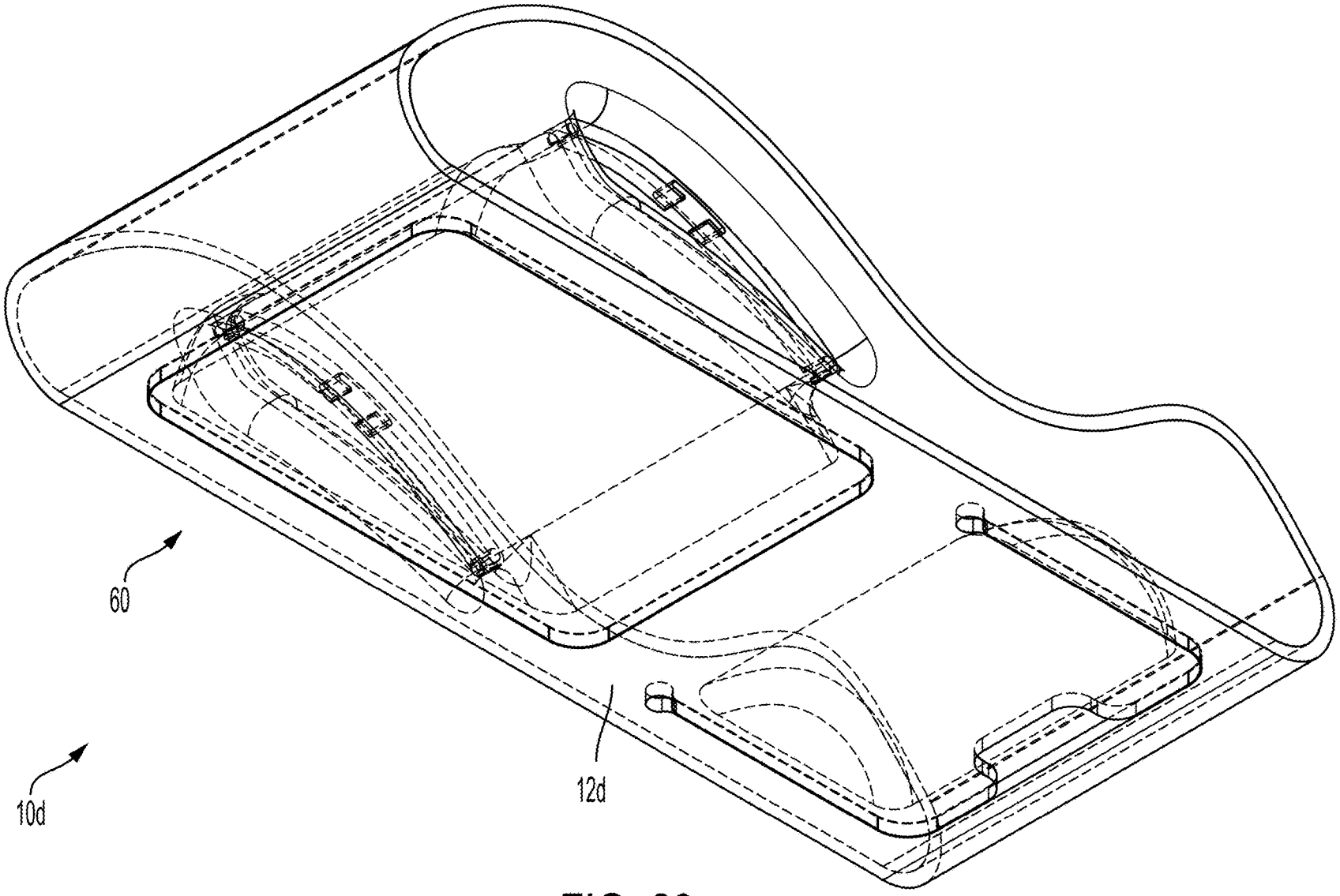
FIG. 29 is a perspective view of an exercise system.
Figure 30:
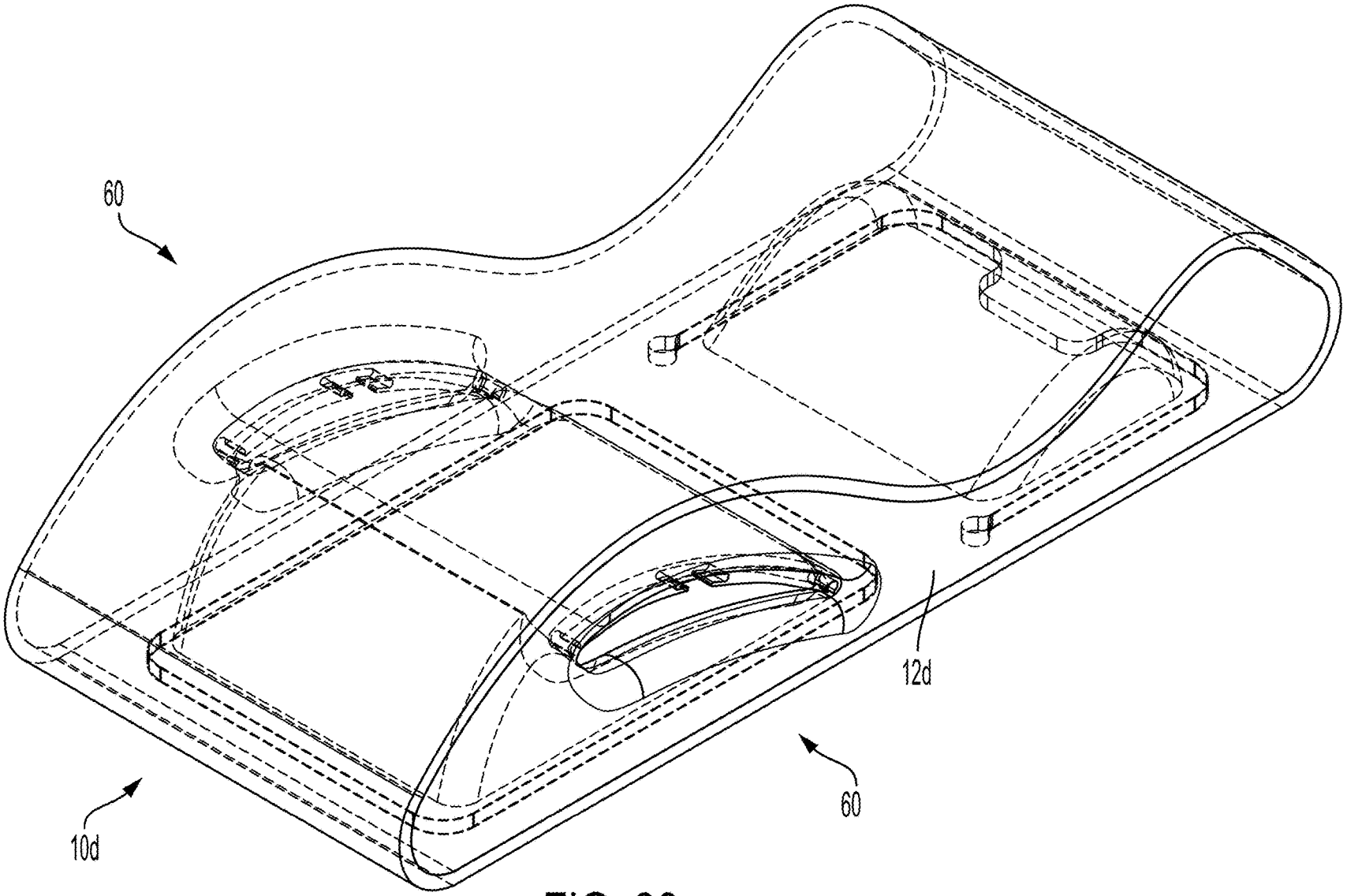
FIG. 30 is an alternate perspective view of the embodiment of FIG. 29.
Figure 31:
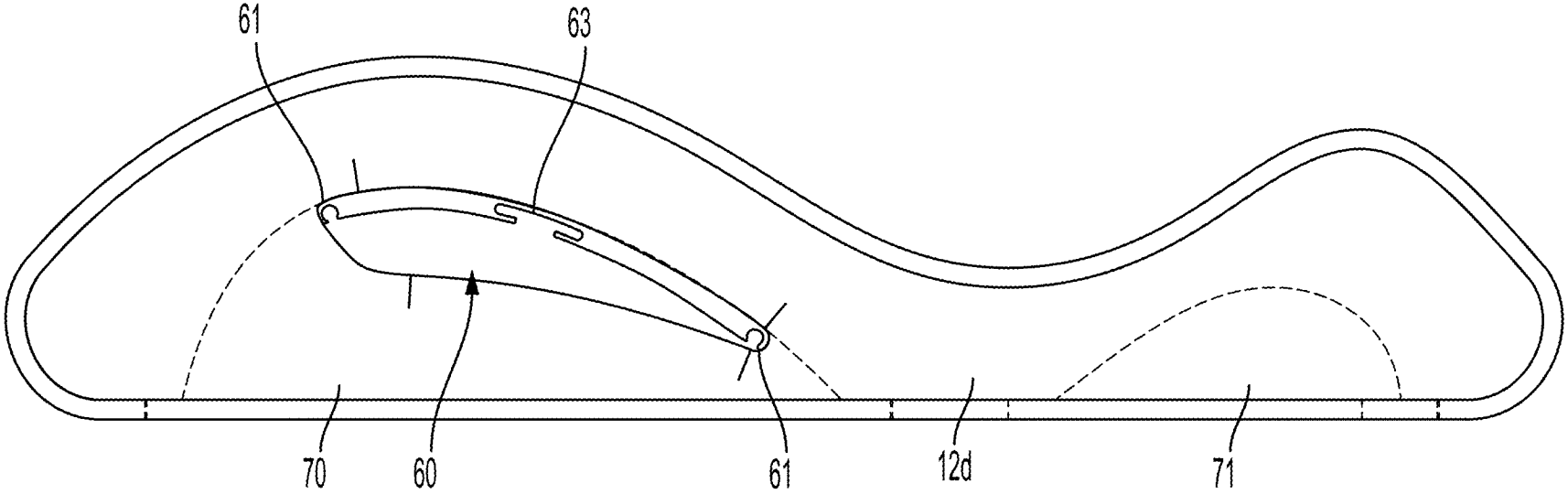
FIG. 31 is a side view of the embodiment of FIG. 29.
Figure 32:
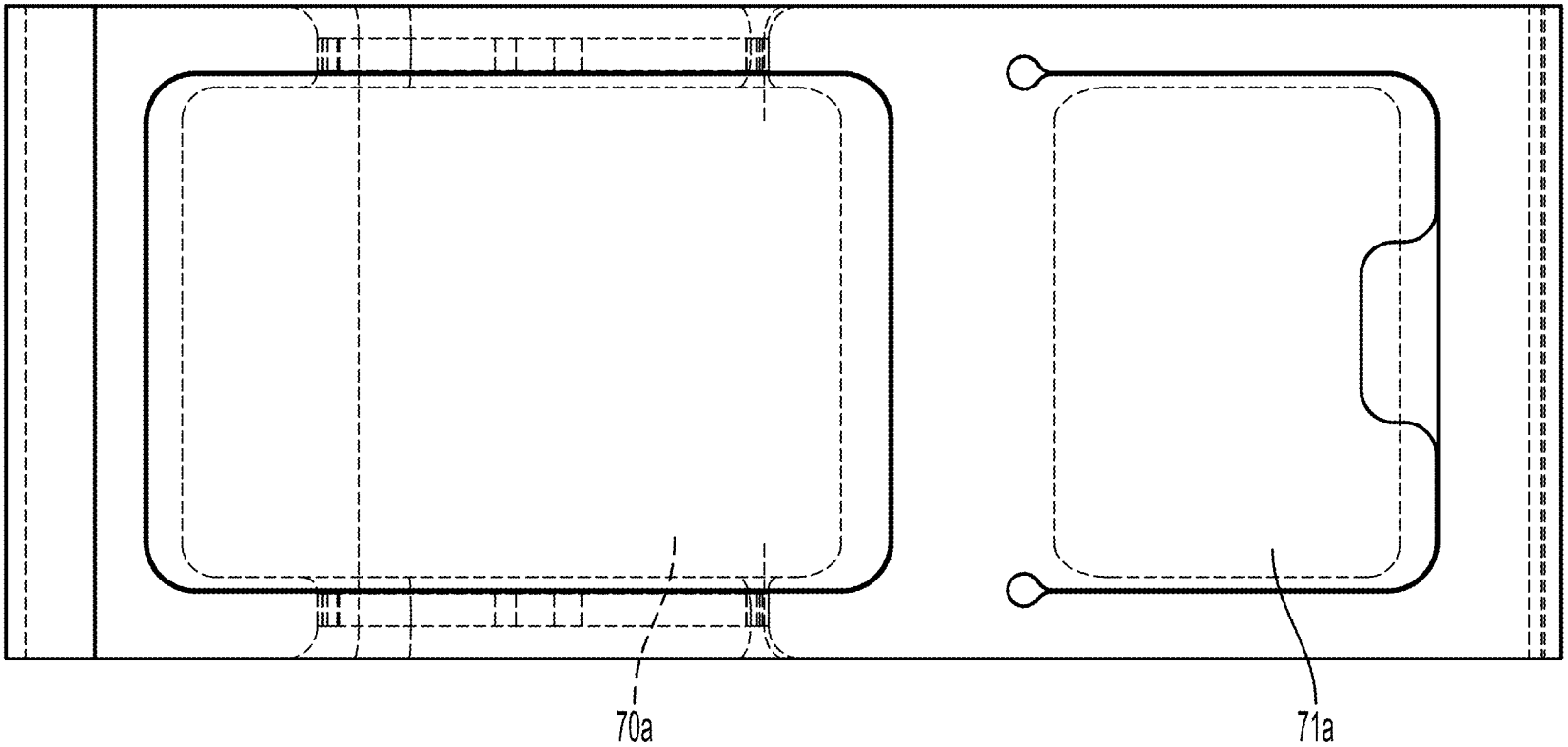
FIG. 32 is a bottom view of the embodiment of FIG. 29.
Figure 33:
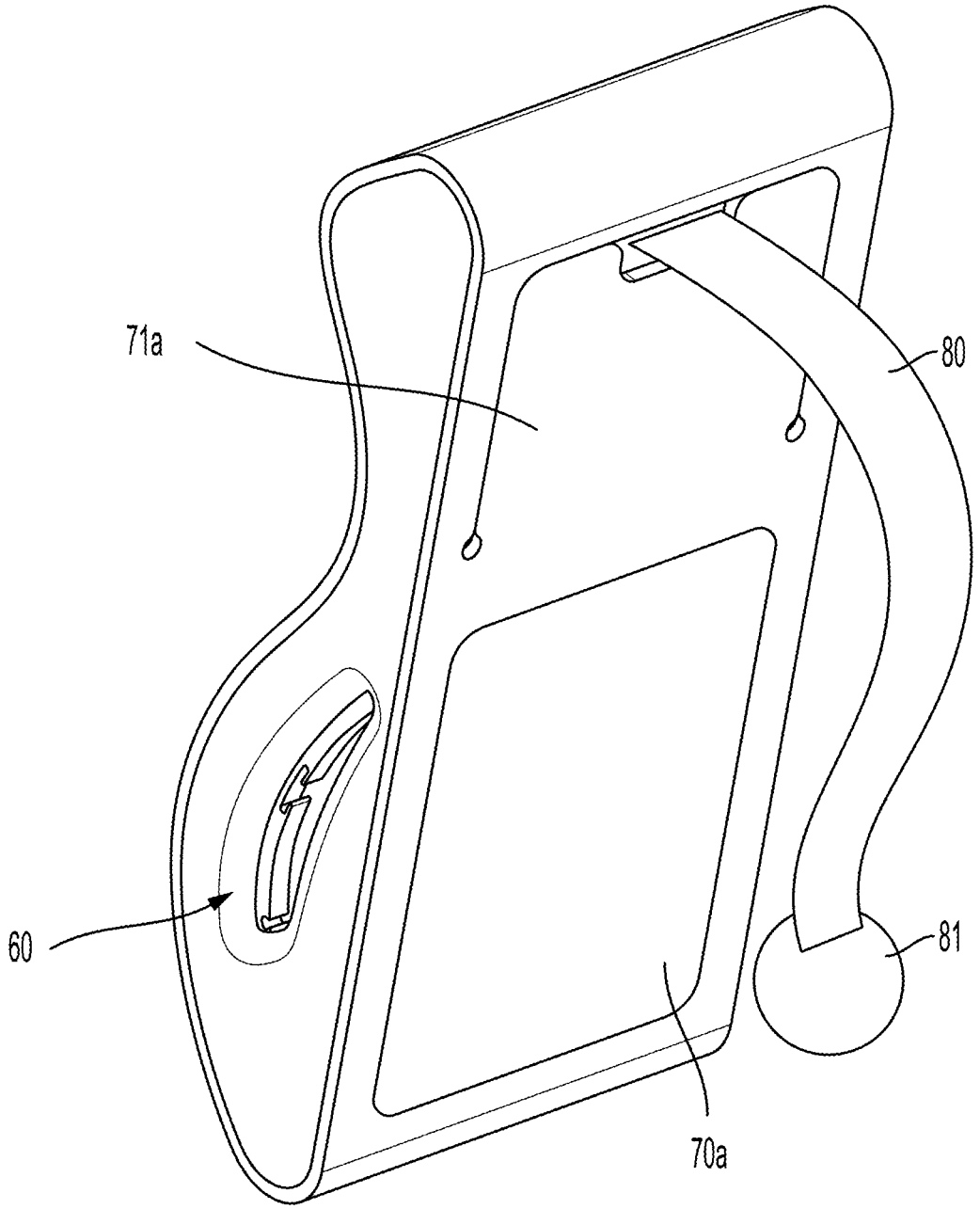
FIG. 33 is a rear view of the embodiment of FIG. 29.

FIGS. 29-33 illustrate an example exercise system 10*d*. FIGS. 29 and 30 are perspective views of an exercise system 10*d* shown in skeleton lines for ease of understanding, FIG. 31 is a side view of the embodiment of FIG. 29, FIG. 32 is a bottom view of the embodiment of FIG. 29, and FIG. 33 is a rear view of the embodiment of FIG. 29. Exercise system 10*d* has a similar shape and components as exercise systems 10 and 10*a*, e.g., body 12*d* comprises a wave like shape having a first peak portion, a trough portion, and a second peak portion and various apertures 60 for securing an elastic band or chord. Accordingly, duplicative description will be omitted. In the example embodiment, exercise system 10*d* includes an aperture 60 extending through the body 12*d*. As seen best in FIG. 31, aperture 60 serves as a common channel or cavity extending through the body 12*d* in a widthwise direction. The aperture 60 may comprise an upper surface having a curved shape generally corresponding to the outermost curved shape of body 12*d* directly above it. Aperture 60 further includes a plurality of fixation points 61, 63 for securing an elastic band. In various embodiments, a first fixation point 61 is disposed at one end of aperture 60 and a second fixation point 61 is disposed at an opposite end of aperture 60. Fixation points 61 may comprise a circular shape, in cross section, and be configured for securing an elastic chord having a corresponding circular shape, in cross section. A third fixation point 63 may be disposed approximately mid-way between the first fixation point 61 and second fixation point 61. In this example, the third fixation point 63 may be configured for securing an elastic ribbon having a planar rectangular/ribbon like shape. Of course any fixation point may be configured for securing an elastic ribbon having a flat ribbon like shape, in cross section, or an elastic chord having a circular or oval like shape, in cross section.

Exercise system 10*d* may further include a first cavity 70 and a second cavity 71. First cavity 70 may be disposed, approximately, beneath a first peak portion of the wave like body 12*d*. Second cavity 71 may be disposed, approximately, beneath a second peak portion of the wave like body 12*d*. With reference to FIG. 32, first cavity 70 may be accessible to an end user via a cover 70*a* removably or hingedly coupled to a bottom surface of body 12*d*. Similarly, second cavity 71 may be accessible to an end user via a cover 71*a* removably or hingedly coupled to a bottom surface of body 12*d*. In various embodiments, covers 70*a*, 71*a* may be die cut and function as a living hinge. In other embodiments, covers 70*a*, 71*a* may be affixed via magnets, spring loaded, or friction assisted snap fittings, for example. In various embodiments, first cavity 70 and second cavity 71 may be used to store things, e.g., exercise ribbons, gloves, nutritional supplements, etc. Another advantage of cavity 70 and cavity 71 may be that they reduce the overall weight of the exercise system. As seen best in FIG. 33, second cavity 71 may store a strap 80 having a gripping end 81. In this embodiment, the entire exercise system 10*d* may be easily carried by an end user by holding on to strap 80 and/or gripping end 81. When the strap 80 and gripping end 81 are not needed for transporting exercise system 10*d*, they may be stored within cavity 71, for example.

Figure 34A:
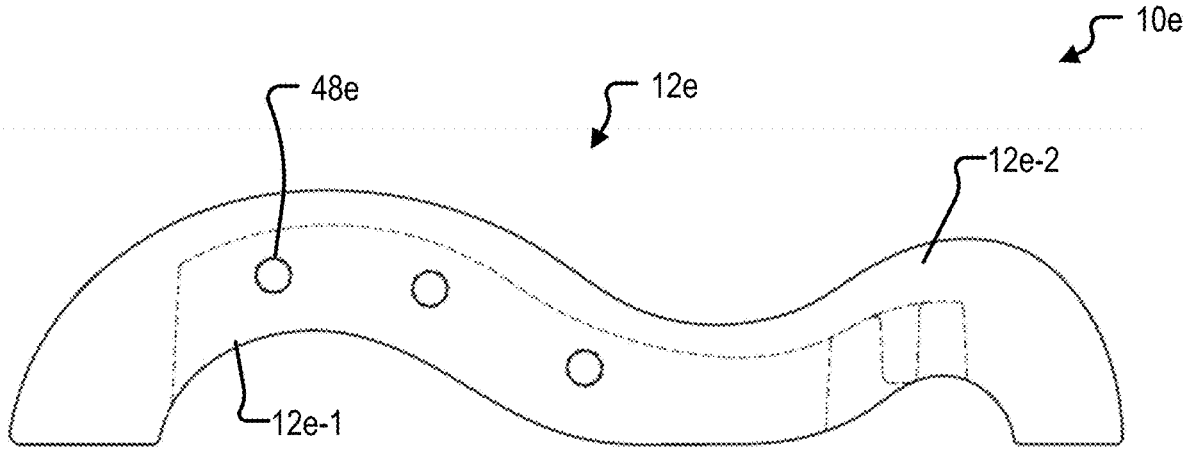
FIG. 34A is a side view of an exercise system.
Figure 34B:
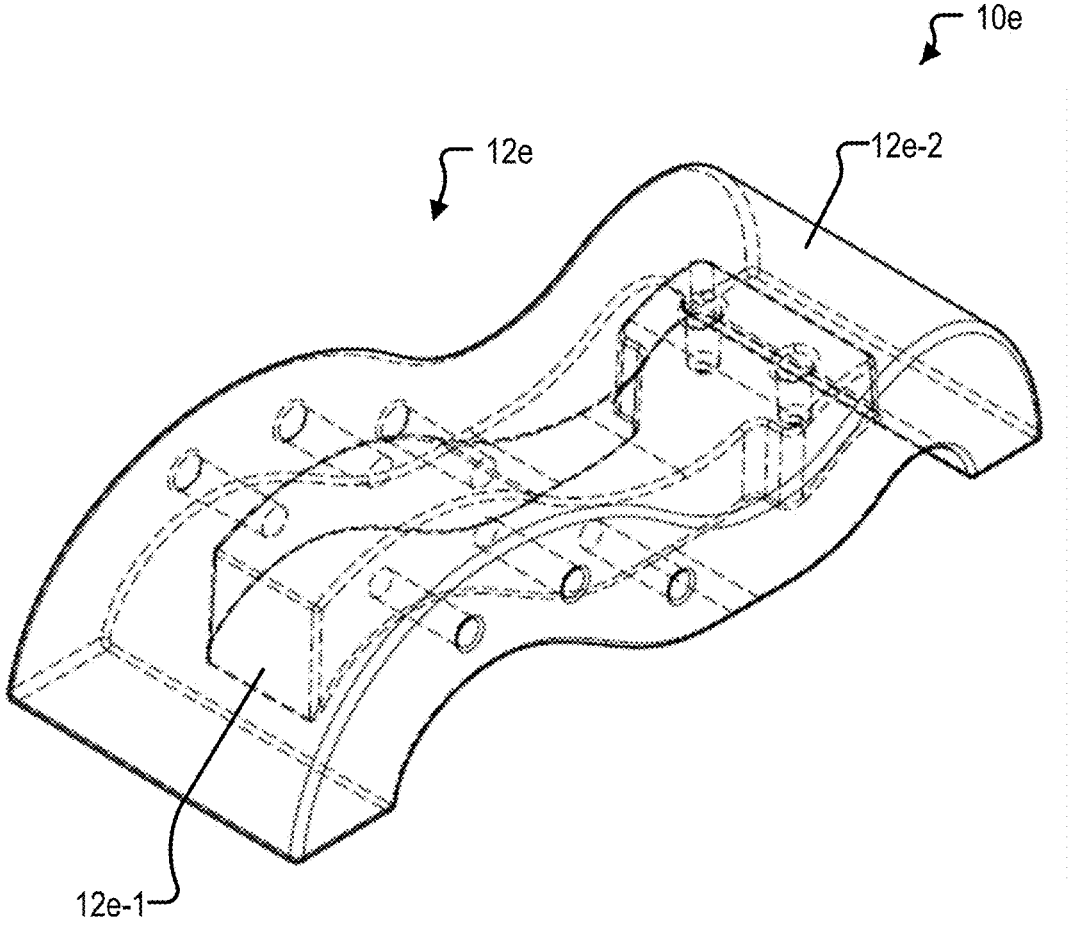
FIG. 34B is a perspective view of an exercise system.

Referring generally to FIGS. 34A-37B various example views of several example exercise embodiments formed of a first foam material and a second foam material are disclosed. FIGS. 34A-34B illustrate a side view and perspective view, respectively, of a fifth embodiment of an exercise system 10*e*. Exercise system 10*e* may have a similar shape and include similar characteristics as exercise system 10*b*, for example. In the example embodiment, exercise system 10*e* includes a body 12*e* formed of a first portion 12*e*-1 and a second portion 12*e*-2. In some embodiments, the first portion 12*e*-1 may be referred to as a core component and the second portion 12*e*-2 may be referred to as a surface component. In the example embodiment, the first portion 12*e*-1 may be formed of a relatively dense and rigid foam material, e.g., a Polyethylene foam or a Polyurethane foam. At least one advantage of utilizing a Polyethylene foam or Polyurethane foam material may be that they are durable, lightweight, resilient, closed-cell materials that provide a high compression strength to weight ratio. Furthermore, these materials may also offer high resistance to chemicals and moisture and exhibit antimicrobial properties. In various embodiments, the second portion 12*e*-2 may be formed of a relatively soft foam, e.g., Ethylene-vinyl acetate (EVA), and/or poly ethylene-vinyl acetate (PEVA). At least one advantage to using an EVA or PEVA foam material for the second portion is that it is relatively low density material with a higher elastic modulus exhibiting superior softness and flexibility thereby making it an ideal choice for an outermost surface of body 12*e*. Other advantages may include the distribution of weight over a larger area that is transferred to the core component. In this embodiment, the inventor has discovered that by utilizing a first portion 12*e*-1 formed of a rigid foam material and a second portion 12*e*-2 formed of a relatively softer foam material surrounding the rigid material an ideal balance between weight, rigidity, and cushioning support is obtained. In some embodiments, body 12*e* may be formed by separately forming first portion 12*e*-1 and second portion 12*e*-2 and then coupling them together by a crosslinking process utilizing an appropriate adhesive. Those with skill in the art will appreciate that it is difficult to securely couple polyethylene foam materials and EVA foam materials and that particular care should be taken. In various embodiments the second portion 12*e*-2 may surround, at least partially, the first portion 12*e*-1. In various embodiments, the first portion 12*e*-1 and second portion 12*e*-2 may be injection foam molded. In some embodiments, the second portion 12*e*-2 may be injection foam molded to include a cavity having a size and shape generally corresponding to the shape of the first portion 12*e*-1 and the first portion 12*e*-1 may be inserted inside of the second portion 12*e*-2. Embodiments in accordance with the principles of this disclosure form a lightweight easily transportable exercise system.

Figure 35A:
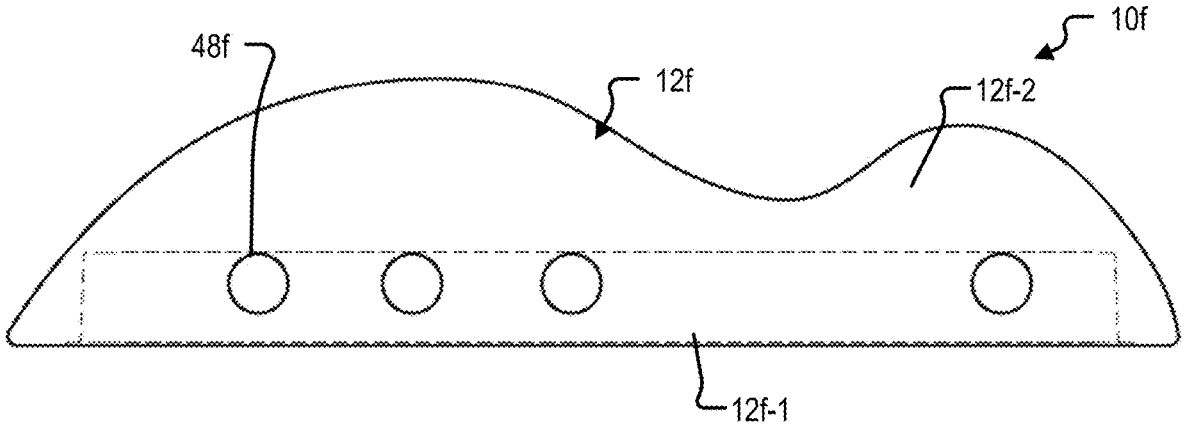
FIG. 35A is a side view of an exercise system.
Figure 35B:
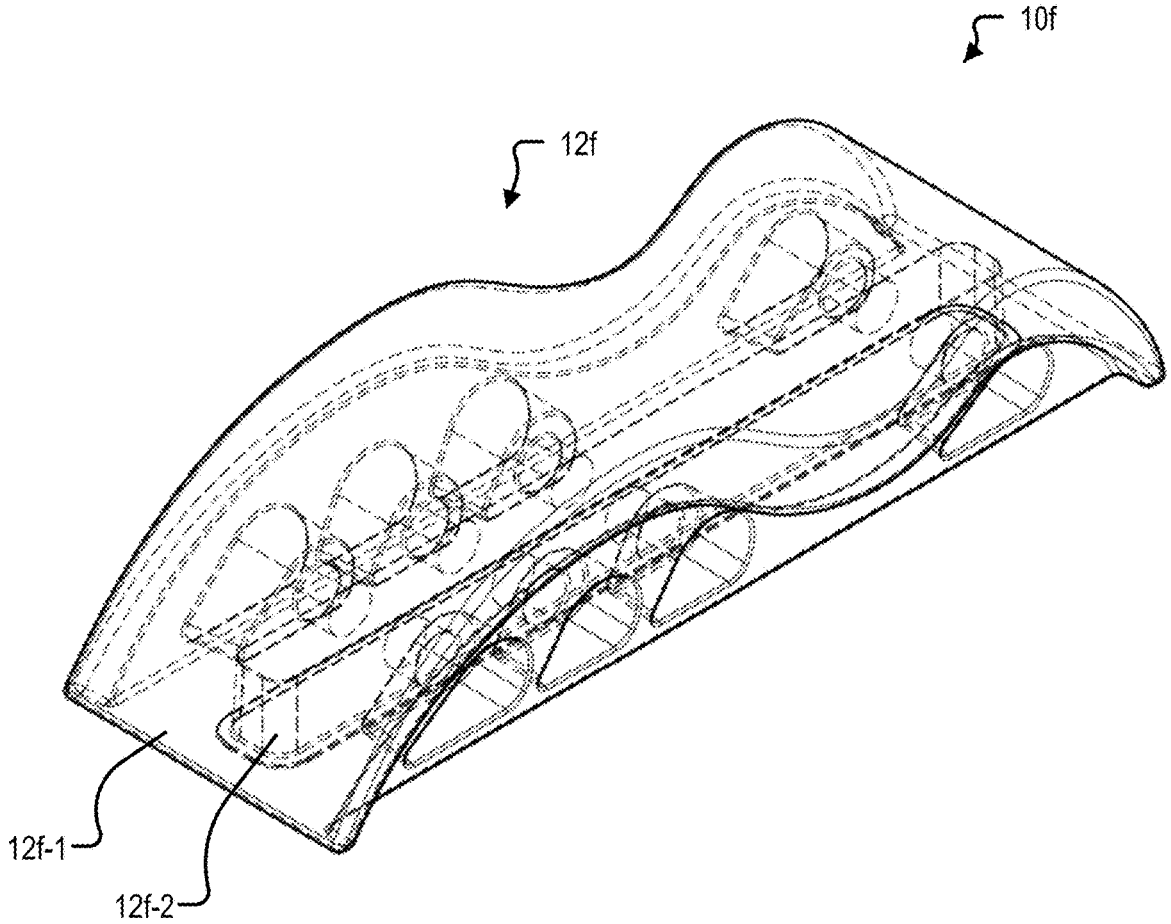
FIG. 35B is a perspective view of an exercise system.

FIGS. 35A-35B illustrate a side view and perspective view, respectively, of a fifth embodiment of an exercise system 10*f*. Exercise system 10*f* may have a similar shape and include similar characteristics as exercise system 10*a*, for example. In the example embodiment, exercise system 10*f* includes a body 12*f* formed of a first portion 12*f*-1 and a second portion 12*f*-2. In some embodiments, the first portion 12*f*-1 may be referred to as a core component and the second portion 12*f*-2 may be referred to as a surface component. In the example embodiment, the first portion 12*f*-1 may be formed of a relatively dense and rigid Poly foam material, e.g., a Polyethylene foam or a Polyurethane foam. In various embodiments, the second portion 12*f*-2 may be formed of a relatively soft foam, e.g., Ethylene-vinyl acetate (EVA), and/or poly ethylene-vinyl acetate (PEVA).

Figure 36:
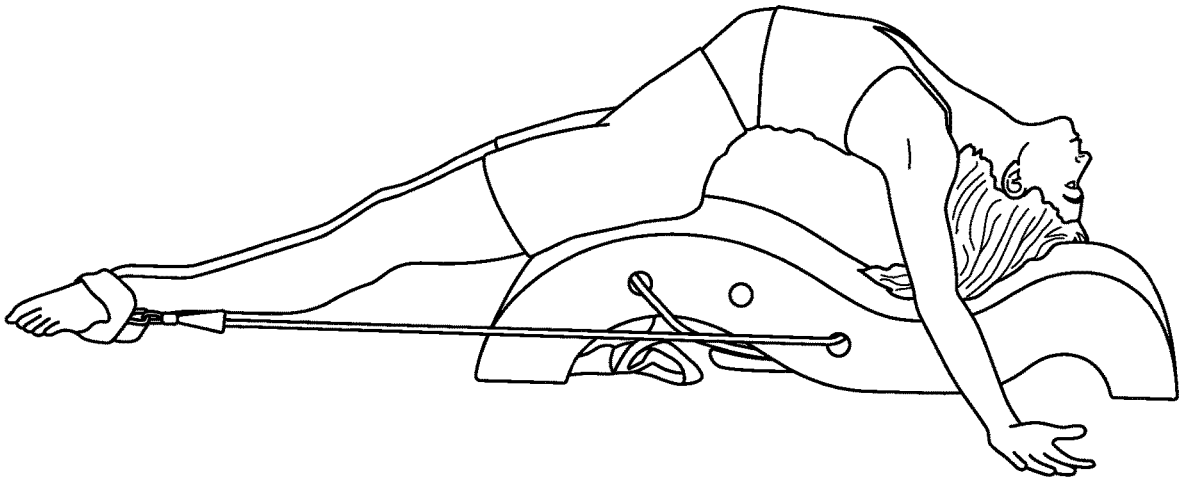
FIG. 36 is a first example of an exercise system in use.
Figure 37:
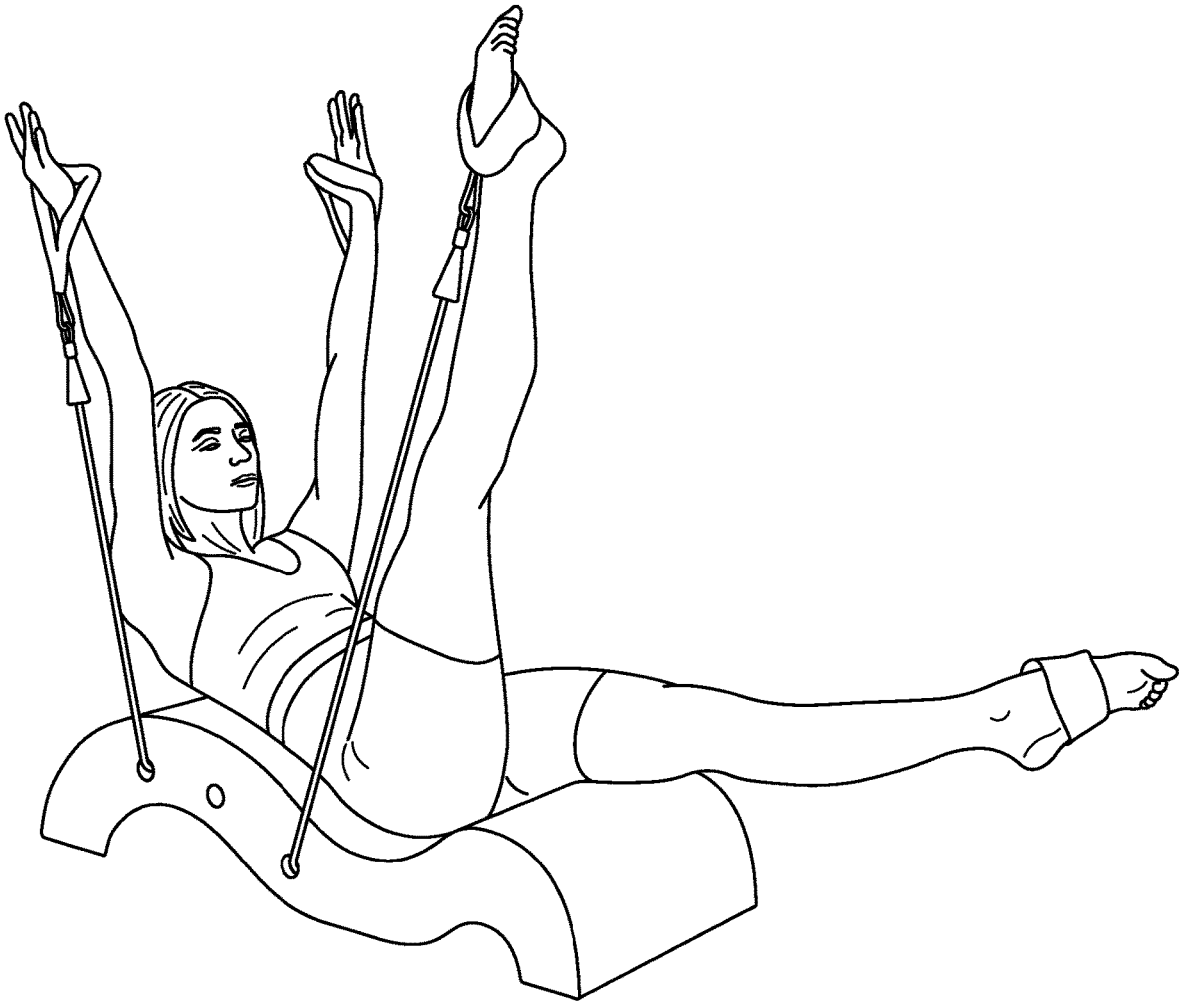
FIG. 37 is a second example of an exercise system in use.
Figure 38:
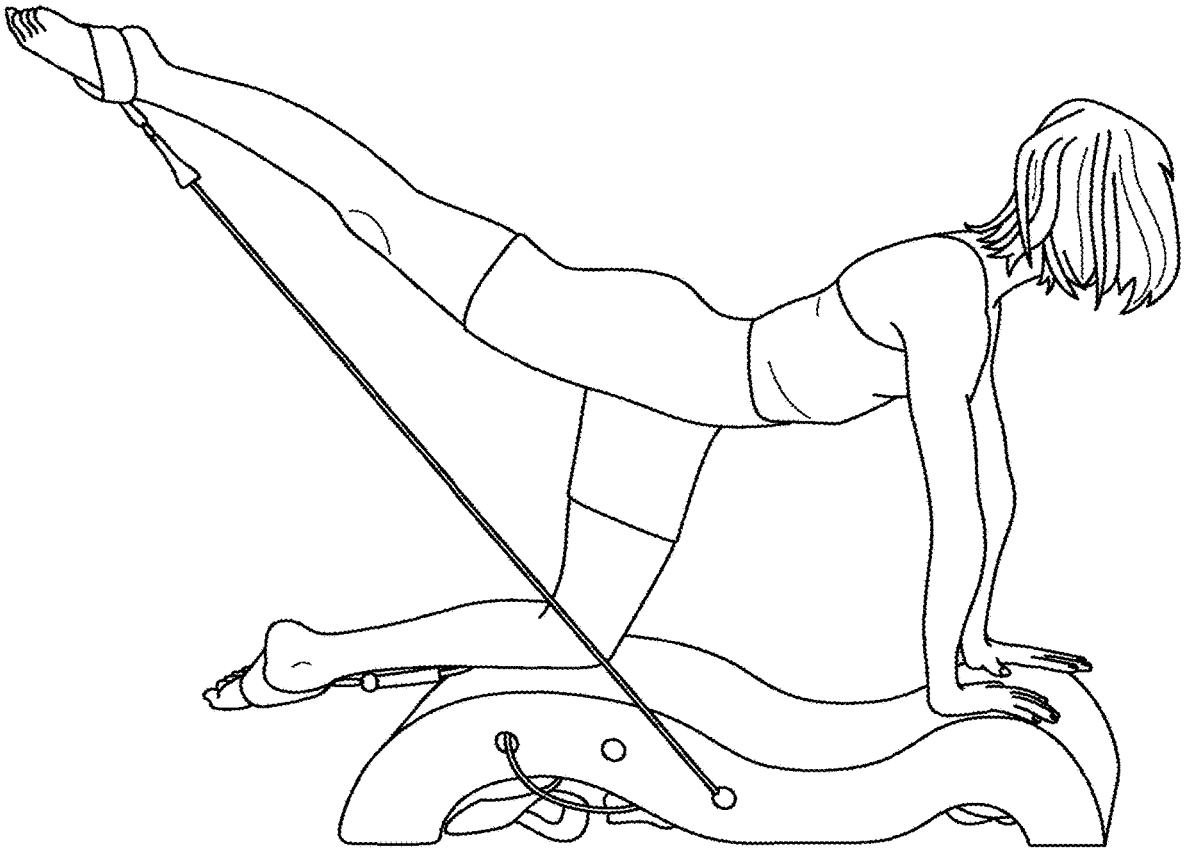
FIG. 38 is a third example of an exercise system in use.

Referring to FIGS. 36-38 various example illustrations of an exercise system in use are shown. In various embodiments, and with reference back to at least FIGS. 1-4, the user can perform one type of exercise by sitting on the outwardly-curved first portion 52*a* of the upper surface 22, with their feet on the floor adjacent to the first portion 52*a*. For this example exercise, the user can grasp handles 16 located on the end of each band 14, and lift the handles 16 upward with or without bending their arms at the elbow, for example. The bands 14 may transfer forces to exercise system 10 through apertures 48. Similarly, resistance may be transmitted to the user by way of handles 16, causing the user to work a particular muscle group against the resistance and thereby exercising that muscle group.

In various embodiments, and with reference back to at least FIGS. 1-4, a user can lie on the upper surface 22, with the user's neck being cradled by the outwardly-curved first portion 52*a* of the upper surface; the user's legs resting on the outwardly-curved second portion 52*b* so that each leg is bent at the knees; and the user's lower back and hips resting in, and supported by the inwardly-curved third portion 52*c*, for example. The user can perform a variety of exercises from this position. For example, the user can stretch their arms outward, and then raise the handles 16 against the resistance generated by bands. Also, the user can work a different muscle group from the same prone position by bending their arms at the elbow, and then pushing upward.

In various embodiments, and with reference back to at least FIGS. 1-4, the user can sit up from the prone position, and from a sitting position raise or push the grips 16 with either bent or straight elbows. Also, the user can align the elastic bands 14 with a different one of the apertures 48 to vary the direction from which the resistance is conveyed to the user's muscle groups, thereby working the muscle groups in a different manner. In still another possible series of exercises, the user can stand on the first portion 52*a* of the upper surface 22 and raise the grips 16 with the user's hands. In another possible series of exercises, the user can attach the bands 14 to a foot, ankle, or lower leg of the user via the grips 16. The user then can move their legs against the resistance of the exercise bands 14 to exercise the legs and lower body. In another possible series of exercises, the user can kneel on the second portion 52*b* of the upper surface 22 while resting their elbows of forearms on the first portion 52*a*. The user can attach the grips 16 to their ankles, and can lift their ankles against the resistance of the elastic bands 14 to exercise the lower body. It shall be understood that the above explained example exercises are described for illustrative purposes only and the exercise system 10 can of course be used to perform other types to exercises.

As can be seen by the various illustrations and detailed description, embodiments in accordance with the principles of this disclosure have many technical advantages. At least one advantage, is the mobility afforded by the compact and lightweight wavelike body, and the durability and conformability of the device, which may be particularly lightweight in the dual foam construction embodiments with cavities. As is most easily appreciated in the use FIGS. 36-38, the end user is afforded a greater biomechanical efficiency by the positioning of a resistance cord in line with the limbs while the body is ergonomically supported by the wavelike body. Another advantage may be the variety of positions at which resistance can be applied during smooth muscular movements, for example in various embodiments the apertures for securing an elastic band are disclosed at different locations along the length of the wavelike body and different relative heights along the height of the wavelike body. Another advantage may be the durability and conformability of the device afforded by the dual layer construction.

It should be understood that various aspects disclosed herein may be combined in different combinations than the combinations specifically presented in the description and accompanying drawings. For example, features, functionality, and components from one embodiment may be combined with another embodiment and vice versa unless the context clearly indicates otherwise. Similarly, features, functionality, and components may be omitted unless the context clearly indicates otherwise. It should also be understood that, depending on the example, certain acts or events of any of the processes or methods described herein may be performed in a different sequence, may be added, merged, or left out altogether (e.g., all described acts or events may not be necessary to carry out the techniques).

Unless otherwise specifically defined herein, all terms are to be given their broadest possible interpretation including meanings implied from the specification as well as meanings understood by those skilled in the art and/or as defined in dictionaries, treatises, etc. It must also be noted that, as used in the specification and the appended claims, the singular forms "a," "an" and "the" include plural referents unless otherwise specified, and that the terms "comprises" and/or "comprising," when used in this specification, specify the presence of stated features, elements, and/or components, but do not preclude the presence or addition of one or more other features, steps, operations, elements, components, and/or groups thereof.

What is claimed is:

1. An exercise system, comprising:

a top portion including a curved body comprising a first peak and a second peak and a trough disposed between the first peak and the second peak that defines a separation distance between the first peak and the second peak, the body extending longitudinally along a longitudinal axis and laterally along a widthwise axis perpendicular to the longitudinal axis;

a first storage cavity disposed underneath the first peak and a second storage cavity disposed underneath the second peak;

a bottom portion including a planar lower surface comprising at least one removable cover configured to open and close and thereby selectively provide access to the first storage cavity or the second storage cavity;

wherein the first peak and the second peak are separated by the separation distance in the longitudinal direction, the first peak extending a first distance in the longitudinal direction and the second peak extending a second distance in the longitudinal direction, the first distance being greater than the second distance; and the system having at least one aperture extending laterally through the curved body for securing an elastic band therein and being disposed underneath the first peak, the at least one aperture comprising an upper surface having a curved shape generally corresponding to a curvature of a top surface of the first peak.

2. The exercise system of claim 1, comprising:

a plurality of apertures, including the at least one aperture, wherein each aperture is disposed at a different elevation relative to the planar lower surface.

3. The exercise system of claim 1, wherein the at least one aperture comprises a passageway having a plurality of fixation points for securing an elastic exercise band.

4. The exercise system of claim 3, wherein a first fixation point of the plurality of fixation points comprises a ribbon slot.

5. The exercise system of claim 4, wherein a second fixation point of the plurality of fixation points comprises a first chord slot.

6. The exercise system of claim 5, wherein a third fixation point of the plurality of fixation points comprises a second chord slot, the first and second chord slots being disposed on opposite sides of the ribbon slot.

7. An exercise system, comprising:

a curved body comprising a first peak and a second peak and a trough disposed between the first peak and the second peak that defines a separation distance between the first peak and the second peak, the body extending longitudinally along a longitudinal axis and a laterally along a widthwise axis perpendicular to the longitudinal axis;

the first peak and the second peak are separated by the separation distance in the longitudinal direction, the first peak extending a first distance in the longitudinal direction and the second peak extending a second distance in the longitudinal direction, the first distance being greater than the second distance;

a first storage cavity disposed underneath the first peak and a second storage cavity disposed underneath the second peak;

a bottom portion including a planar lower surface comprising at least one removable cover configured to open and close and thereby selectively provide access to the first storage cavity or the second storage cavity;

the curved body including a core component and a surface component surrounding the core component; and the curved body having at least one aperture extending laterally therethrough for securing an elastic band therein and being disposed underneath the first peak, the at least one aperture comprising an upper surface having a curved shape generally corresponding to a curvature of a top surface of the first peak.

8. The exercise system of claim 7, wherein the core component comprises a first foam material and the surface component comprises a second foam material.

9. The exercise system of claim 7, wherein the core component consists essentially of a first material chosen from Polyethylene foam and/or Polyurethane foam and the surface component consists essentially of a second material chosen from Ethylene-vinyl acetate, and/or polyethylene vinyl acetate.

10. The exercise system of claim 7, comprising:

a plurality of apertures, including the at least one aperture, wherein each aperture is disposed at a different elevation relative to the planar lower surface.

11. The exercise system of claim 7, further comprising a transport strap coupled to the curved body.

12. The exercise system of claim 7, wherein the core component comprises a first material chosen from Polyethylene foam and/or Polyurethane foam and the surface component comprises a second material chosen from Ethylene-vinyl acetate, and/or polyethylene vinyl acetate.

13. The exercise system of claim 12, wherein the first material and the second material are adhered together by a cross-linking adhesive.

14. The exercise system of claim 7, wherein the at least one aperture comprises a common passageway having a plurality of fixation points, each fixation point being configured for securing an elastic exercise band, respectively.

15. The exercise system of claim 14, wherein a first fixation point of the plurality of fixation points comprises a ribbon slot.

16. The exercise system of claim 15, wherein a second fixation point of the plurality of fixation points comprises a first chord slot.

17. The exercise system of claim 16, wherein a third fixation point of the plurality of fixation points comprises a second chord slot, the first and second chord slots being disposed on opposite sides of the ribbon slot.

* * * * *